US006084607A

United States Patent [19]

Matsuda

[11] Patent Number: 6,084,607

[45] Date of Patent: Jul. 4, 2000

[54] INK-TYPE IMAGE FORMING DEVICE WITH MOUNTING-POSITION-ERROR DETECTION MEANS FOR DETECTING DEVIATIONS IN POSITION OF RECORDING HEADS

[75] Inventor: Yuji Matsuda, Tokyo, Japan

[73] Assignee: Copyer Co., Ltd., Tokyo, Japan

[21] Appl. No.: 09/051,925

[22] PCT Filed: Oct. 17, 1996

[86] PCT No.: PCT/JP96/03005

§ 371 Date: Jun. 15, 1998

§ 102(e) Date: Jun. 15, 1998

[87] PCT Pub. No.: WO97/14563

PCT Pub. Date: Apr. 24, 1997

[30] Foreign Application Priority Data

Oct. 18, 1995 [JP] Japan ..... 7-269957

[51] Int. Cl.[7] ..... B41J 29/393

[52] U.S. Cl. ..... 347/19; 347/37

[58] Field of Search ..... 347/19, 37, 43, 347/9, 12, 107; 118/691; 399/49, 72

[56] References Cited

U.S. PATENT DOCUMENTS 4,675,696 6/1987 Suzuki ..... 347/19 X 5,404,020 4/1995 Cobbs ..... 347/19

5,600,350 2/1997 Cobbs et al. ..... 347/19

*Primary Examiner*—William Royer

*Assistant Examiner*—Hoan Tran

*Attorney, Agent, or Firm*—Dellett and Walters

[57] ABSTRACT

An ink-type image forming device which accurately identifies a print pattern (test pattern) even in the case where a recording medium is somewhat raised or the recording medium is low in reflectance in an attempt to find a deviation in relative position of recording heads. When the output of a light receiving element (22) is subtracted from the output of a light receiving element (21), both the outputs are offset by each other since variations in output are small at an area where the recording medium is raised. In the meantime, the light receiving elements are spaced in the direction (X) of movement of a carriage, and the output of the light receiving element corresponding to respective regions which constitute the print pattern steeply changes. As a result, a peak signal corresponding to the respective regions of the print pattern is obtained as a difference signal of outputs of the light receiving elements (FIG. 8(D)). Accordingly, even if the recording medium happens to be raised, positions where the respective regions of the print pattern are existent can be positively detected.

14 Claims, 30 Drawing Sheets

EXTERNAL DEVICE
1
VDI
HEAD CONTROL UNITS
5
VDO,BENB
HENB
×4
HEADS
3
×4
PRINT CONTROL UNIT
2
CPU
4
ROM
18
UPPER COVER OPEN/CLOSE DETECTION UNIT
10
IMAGE MEMORY
19
REGISTRATION ERROR DETECTION UNIT
7
PATTERN DETECTION UNIT
6
LINEAR SCALE
8
LINSCL
SENSOR
9
15

14
X
21
22

So 1
GND
8 2

So 2
GND
8 3

SUB
GND
84
85

81
D
15
16

INK-TYPE IMAGE FORMING DEVICE WITH MOUNTING-POSITION-ERROR DETECTION MEANS FOR DETECTING DEVIATIONS IN POSITION OF RECORDING HEADS

TECHNICAL FIELD

The present invention relates to an ink-type image forming device and particularly to such a device which includes a plurality of recording heads for multi-color printing.

BACKGROUND ART

An ink-jet system, one of ink recording systems, is a system in which a nozzle, filled with ink derived from an ink container, includes a heater which is driven with a pulse signal for heating the nozzle to eject an ink drop by the pressure of an air bubble that is created in the ink by the heating. In an image forming device employing such an ink-jet recording system, an image is formed using a recording head which is constituted by a plurality of nozzles aligned in line.

As shown in FIG. 11, a recording head 3 (heareinafter referred to as only "head") mounted on a carriage is moved in a main-scanning direction (X) to successively print a multiple of columns 17 one by one on a sheet of paper 15 to form one band of an image. Then, the paper sheet 15 is moved in a sub-scanning direction (Y) to form a second band of the image which adjoins the first band. In order to form a full-color image, a plurality of recording heads are used which eject ink drops of different colors, e.g., cyan C, magenta M, yellow Y and black K, to perform a printing with the colors overlapped with each other.

However, the printing with the plurality of recording heads of different colors as described above to form a full-color image suffers from the following drawbacks. As shown in FIG. 12, misalignment or deviation D1 in relative position of the plurality of heads could be present among the heads in a lateral or main-scanning direction. Such deviation D1 will cause a vertical stripe pattern in a printed image. FIG. 12 shows an example in which only the head of magenta M is misaligned leftward by an amount D1 with respect to other heads. Likewise, as shown in FIG. 13, deviation D2 in a vertical or sub-scanning direction could also be present among the plurality of heads. Such deviation D2 will cause a horizontal stripe pattern to appear in a printed image. FIG. 13 shows an example in which only the head of magenta M is misaligned downward by an amount D2 with respect to other heads. Thus, the deviation among the heads could degrade a printed image.

There is an ink-type image forming device which synchronizes the ejection of ink drops by using a linear scale 301, which has slits 303 regularly provided therealong for every dot position, and a linear sensor 302, which is movable along the linear scale 301 to detect the presence/absence of the slits at any position thereof, as shown in FIG. 14 to eject ink drops at accurate points corresponding to individual positions in the main-scanning direction of the heads. This type of image forming device, when performing a bi-directional (or two-way) printing in which printing is made in both forward and backward paths of the heads moving along the main-scanning direction, as shown in FIG. 15(*a*), in the forward path a delay time d1 is created from the detection of a slit to the actual ejection of an ink drop whereas in the backward path a delay time d2 is similarly created. Thus, the sum of the delay times makes (d1+d2). The sum of the delay times (d1+d2) could degrade a printed image because of the deviations (D5) of ejected positions of ink drops between the forward and backward paths in spite of attempting to print dots at the same position P. The image degradation is significant especially when printing a line drawing. For example, as shown in FIG. 15(*b*), when ideally one vertical line 151 is to appear, two parallel dashed lines 12 would be printed.

The configuration of a head is classified into two types: an integrated type in which an ink container is integrated with an associated head as shown in FIG. 16(*b*) and a separate type in which a head 3 is separate from an ink container 3' as shown in FIG. 16(*a*).

The integrated type recording heads are handled as consumable supplies which are exchanged arbitrarily by a user when the ink container runs short of ink. Therefore, each time of the exchange of a head, alignment of the head should be checked and, if any, corrected.

On the other hand, in the separate type of recording heads when ink in an ink container has been consumed, a user exchanges only the ink container, leaving the recording head intact at its fixed position. Therefore, in principle, it is sufficient to correct the abovementioned deviation of the recording heads only when shipping products from a factory. However, it could be necessary to exchange a head at a user site in an occurrence of failure of the head or the like. In such a case, deviation of the head could occur and it is desirable to be able to correct the deviation at a user site.

In order to correct the deviation of heads, it is necessary to accurately detect the amount of the deviation. The detection of the deviation is performed as follows: Each time a head is exchanged, a predetermined print pattern or test pattern is recorded on a sheet of paper, as shown in FIG. 17. In this example, a vertically elongated rectangular region a (referred to as a reference region hereinafter) is recorded with a head of a particular color (black in this case), which acts as a reference for alignment in position, while successively recording a black region b, a cyan region c, a magenta region d, and a yellow region e (referred to as compared regions hereinafter), respectively at instructed positions laterally spaced away from the reference region, in the order mentioned from the upper to the lower. These regions a to e are all printed in the same direction (here from left to right). Regarding the regions b to e, some of them which have deviation of the heads would not be aligned with other regions, despite of intending to print the regions at aligned positions. It is shown in the illustrated example that the cyan head has a misalignment error, resulting in a lateral shift of the region c relative to the other regions.

For detection of print deviations in printing in both forward and backward paths of the heads, the region a is printed vertically lengthened as shown by a dashed line in FIG. 17. Corresponding to this lengthened portion, an additional region f is printed with the head of the same color (black) as the region a at the same lateral position as the regions b to e. Only the region f, unlike the other regions, is printed in the reverse direction (from right to left). It is found that due to the above-mentioned delay d1+d2, the region f is shifted leftward with respect to the region b of the same color.

The print pattern shown in FIG. 17 is detected by a sensor 9 which is mounted on the carriage near the head and optically reads the pattern to calculate the amounts of deviation of each head. Hereinafter, the deviation of heads is also referred to as a registration error.

As shown in FIG. 18, the sensor for detecting the print pattern is constituted by a light emitting element 601, a light receiving element 602 (e.g. a photodiode), and a lens 603. FIGS. 18 (*a*) and (*b*) illustrate a front view and a plane view of the sensor, respectively. In FIG. 18, a carriage moving direction (main-scanning direction) is indicated by "X", and a direction perpendicular to the carriage moving direction is indicated by "Y". The light emitted from the light emitting element 601 is projected onto the surface of a paper sheet, and the reflected light is received through the lens 603 by the light receiving element 602.

When an output of the sensor is small, as shown in FIG. 19 the sensor output was current-to-voltage converted by an amplifier circuit 701, amplified by an inverting amplifier circuit 702, and then compared with a predetermined threshold voltage in a comparator 703 to be converted into bi-level digital data, and digitally processed.

Such configuration of an image forming device is disclosed in Japanese Patent Application No. 6-120160 (Patent Laid-open No.-323582).

However, the printed sheet of paper used for detecting the registration errors is not necessarily laid ideally flat, but part or entirety of the sheet could be raised or float at a height D0 (approximately a couple of millimeters). When such floating of the sheet has occurred, the illuminated position of the light from the light emitting element 601 on the sheet will move from a position P2 to P1, changing the distance from the lens 603 to the surface of the printed sheet, which results in a out-of-focus state. For this reason, as shown in FIG. 21, a sensor output So (FIG. 21(*b*)) of the sensor 9 (FIG. 21(*a*)) becomes unstable, and hence, it will be impossible to discriminate between the actual printed region 14 (FIG. 21 (*a*)) and a floating point 81 of the paper sheet 15 (FIG. 21(*d*)). That is, no accurate bi-level digitization with a threshold level Th could be performed, creating a pulse 86 (FIG. 21(*c*)), which corresponds to the floating point 81, in the bi-level output Bo, resulting in an erroneous deletion of the printed pattern.

Even if the bi-level digitization can successfully be achieved, the amplitude of the sensor output will vary between at floating points and at non-floating points of the paper sheet, causing an error in the detection of an edge position of the bi-level output, which could degrade the accuracy in detecting the printed pattern.

Further, a user sometimes uses intermediate paper (e.g., tracing paper) as a recording medium. In this case, as shown in FIG. 22, intermediate paper 222 has less light reflected therefrom than normal paper 221 so that it could be impossible to detect the peak of the sensor output So, which corresponds to the printed region 14, because of the insufficient light loser than a threshold level Th1. For this reason, the threshold level for bi-level digitization should be changed to a lower level Th2 depending upon the papers to be used.

It is an object of the invention to provide an ink type image forming device which can accurately detect a printed pattern even if there is some floatage of a recording medium, on which the pattern is printed, in detecting deviation of a plurality of recording heads, or even if the recording medium has a low reflectance.

DISCLOSURE OF THE INVENTION

According to the present invention, there is provided an ink type image forming device on which a plurality of recording heads are mounted and moved so that an image is formed on a recording medium, said device comprising: a test pattern printing means for printing a predetermined test pattern on a recording medium by the use of the plurality of recording heads; a reading means for reading the test pattern printed by said test pattern printing means by optically scanning the test pattern; a mounting-position-error detection means for detecting deviations in position of the recording heads with respect to a reference one of the plurality of recording heads, based on reading results of the reading means; said reading means including a light emitting element for emitting light on the recording medium, and first and second light receiving elements for receiving light reflected from the recording medium, said first and second light receiving elements being spaced apart with each other by a predetermined distance, and said position error detection means including a subtracting means for subtracting an output of one of said first and second light receiving elements from an output of the other, and means for determining the deviations in position on the basis of the subtracted output.

With this arrangement, as shown in FIG. 8, when an output So2 (FIG. 8(*c*)) of a second light receiving element 22 is subtracted from an output Sol (FIG. 8(*b*)) of a first light receiving element 21, the outputs corresponding to the floating portions 82 and 83 of the printed paper are canceled with each other because changes in the outputs due to the floatage are small. On the other hand, the outputs corresponding to each region of the printed pattern will leave the peaks 84 and 85 of the first and second light receiving elements intact even after the difference between the two outputs has been taken, because the first and second light receiving elements are disposed spaced apart from each other and their outputs change steeply (See FIG. 8(*d*)). Therefore, as shown in FIG. 8(*e*), the position of the printed pattern is accurately detected even if there is a floating portion 81 or the reflectance of the recording medium is low.

Preferably, the device comprises a head scanning means for causing the plurality of recording heads to move in a main-scanning direction across the recording medium, and a recording medium travelling means for moving the recording medium in a sub-scanning direction perpendicular to the main-scanning direction, the first and second light receiving elements being disposed substantially at the same distance from the light emitting element and the first and second light receiving elements being aligned along a line which is inclined at a predetermined angle with respect to the recording-head moving direction X (main-scanning direction) and the recording-medium moving direction Y (sub-scanning direction).

That is, as shown in FIG. 10, the first and second light receiving elements 21 and 22 are equally spaced from the light emitting element 23, while the common center axis through the light receiving elements 21 and 22 inclines at a predetermined angle (e.g., 45 degrees) with respect to the head moving direction (carriage moving direction or main-scanning direction) and the recording-medium moving direction (paper-travelling direction or sub-scanning direction).

As shown in FIG. 10, if the light receiving elements 21 and 22 were not tilted (the status shown in a dashed-line box), then when reading the laterally elongated region P3 the outputs from the light receiving elements 21, 22 would be successively produced with a time difference with respect to the region P3, resulting in a change of the subtracted output only at the position of the region P3. However, when reading the vertically elongated region P4 with the light receiving elements 21, 22 as indicated by the dashed-line box, the outputs from the light receiving elements 21, 22 would simultaneously change with respect to the region P4, resulting in no change in the subtracted output notwithstanding the presence of the region P4. In order to avoid such an inconvenience, the light receiving elements 21, 22 are aligned at a tilt.

Preferably, the mounting-position-error detection means may include first and second amplifiers for amplifying the outputs of the first and second light receiving elements, respectively, and a gain control means for automatically controlling at least one of the first and second amplifiers so that the outputs of the light receiving elements are at an equal level, with the light emitting element tuned on. This makes it possible to deal with undesired change in the output levels of the light receiving elements due to the shift of the position illuminated by the light emitting element, which could occur based on the errors in adjustment of the head height or due to various factors in manufacture.

In addition to or separately from this arrangement, the mounting-position-error detection means may include first and second amplifiers for amplifying the outputs of the first and second light receiving elements, respectively, and an automatic offset control means for automatically controlling at least one of reference levels for the first and second amplifiers so that the outputs of the light receiving elements are at an equal level, with the light emitting element tuned off. This enables dealing with the difference between the temperature characteristics of the two light receiving elements.

In detecting a region of the test pattern, it is desirable to detect the center position within the width of the region. This enables dealing with the difference between amplitudes of the outputs from the light receiving elements, which occur depending on the difference of light absorptances of respective regions in different ink colors.

BEST MODE FOR CARRYING OUT THE INVENTION

Now, preferred embodiments of the present invention will be described below in detail with reference to the attached drawings. Aforementioned parts are assigned with the same reference symbols and will not be explained again.

Figure 1:
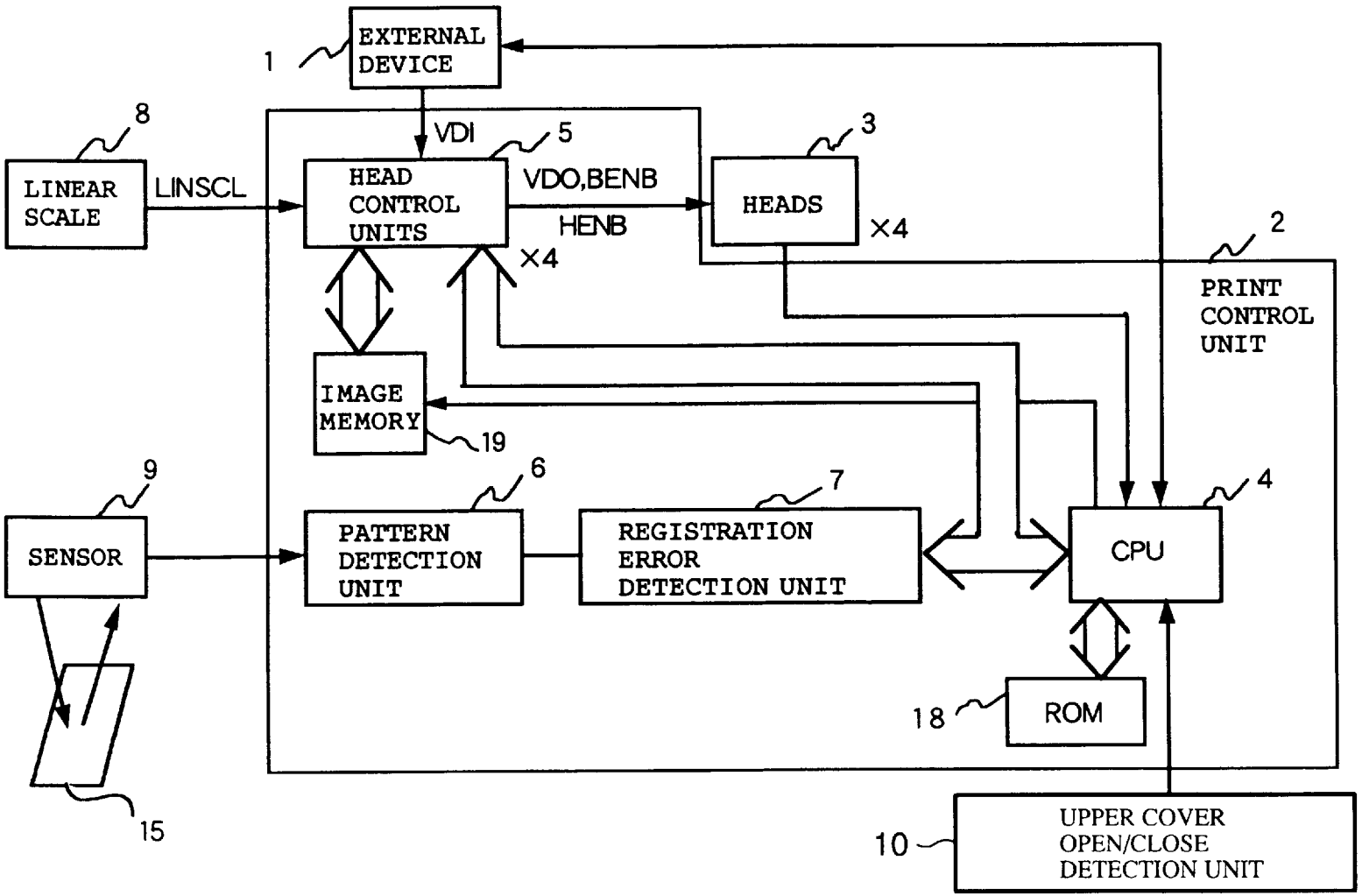
FIG. 1 is a block diagram which shows an embodiment of the ink type image forming device according to the present invention.
Figure 2:
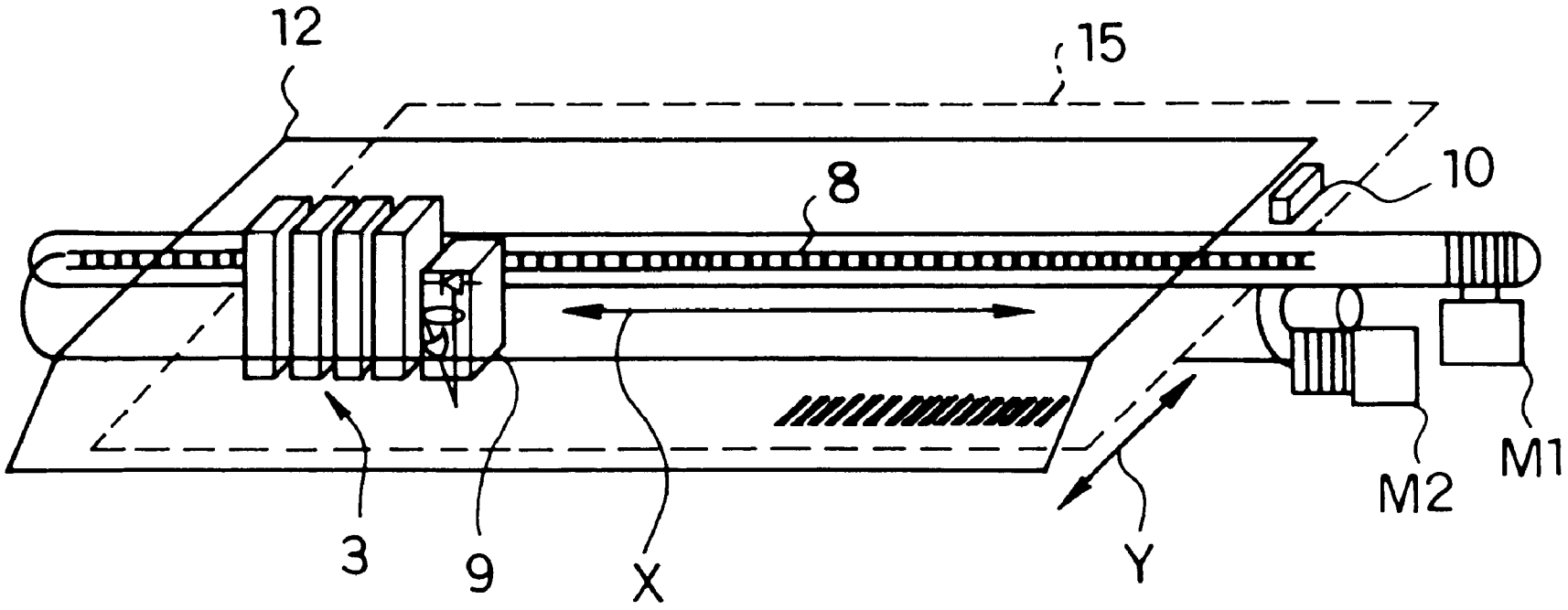
FIG. 2 is a perspective view of parts of the embodiment.

FIG. 1 is a block diagram which shows an embodiment of the ink type image forming device according to the present invention, and FIG. 2 is a perspective view showing an arrangement of respective parts of the device.

As shown in FIGS. 1 and 2, an ink type image forming device generally comprises three parts: an external device 1 including an image scanner, a personal computer, a CAD device, etc., a print control unit 2 and heads 3. The ink type image forming device of such a configuration generally operates as follows. The print control unit 2 perform a predetermined processing with respect to image data VDI, which is forwarded from the external device 1, and then the heads 3 forms an image on a printing paper sheet based on the result of the processing.

More specifically, the print control unit 2 includes a CPU (Central Processing Unit) 4, head control units 5, a pattern detection unit 6, a registration error detection unit 7 for detecting amounts of deviations of respective heads based on the values detected by the pattern detection unit 6, an ROM (Read Only Memory) 18 which stores programs to be executed by the CPU 4 and pattern data to be printed, an image memory 19 for temporarily storing image data. The CPU 4 interfaces with the external device 1 which forwards the image data VDI, and controls the entire operation of the print control unit 2 including memories (not shown), I/O devices, etc. Upon receipt of the image data VD1 forwarded from the external device 1, the heads control units 5, instructed from the CPU 4, temporarily stores a few bands of the image data VD1 in the image memory 19. The stored image data VD1 are subjected to various image processing and resultant image data VDO are output in synchronism with the scanning of the heads 3. The synchronization for the print control of the image data VDO, etc. is performed by using a signal LINSCL which is generated from a linear scale 8 in synchronism with the scanning of the heads 3.

The head control unit 5 also creates enable signals BENB0-7 for the respective blocks of each head 3, and pulse signals for driving heaters (i.e., signals necessary for ejecting ink drops). In this example, each head 3 includes 128 nozzles which are divided into eight blocks, and hence, uses eight block-enable signals.

The image data VDO, block-enable signals BENB0-7, heater driving pulse signals HENB, etc. outputted from the head control units 5 will be forwarded to the heads 3 where control circuits in the heads 3 drive heaters on for only nozzles whose associated image data VDO and enable signals (BENB, HENB) are enabled, so that ink drops are ejected onto a printing paper sheet to form a column of image. Such a control is repeated while moving the heads 3 in the main-scanning direction so as to form a band of image. In this case, four heads 3 are used, and corresponding to these heads, four head control units 5 are also used. The heads 3 are equipped with integrated type of ink containers of cyan, magenta, yellow and black, respectively, to realize a full-color printing. In the description below, only circuitry for one of the sets will be explained.

Figure 17:
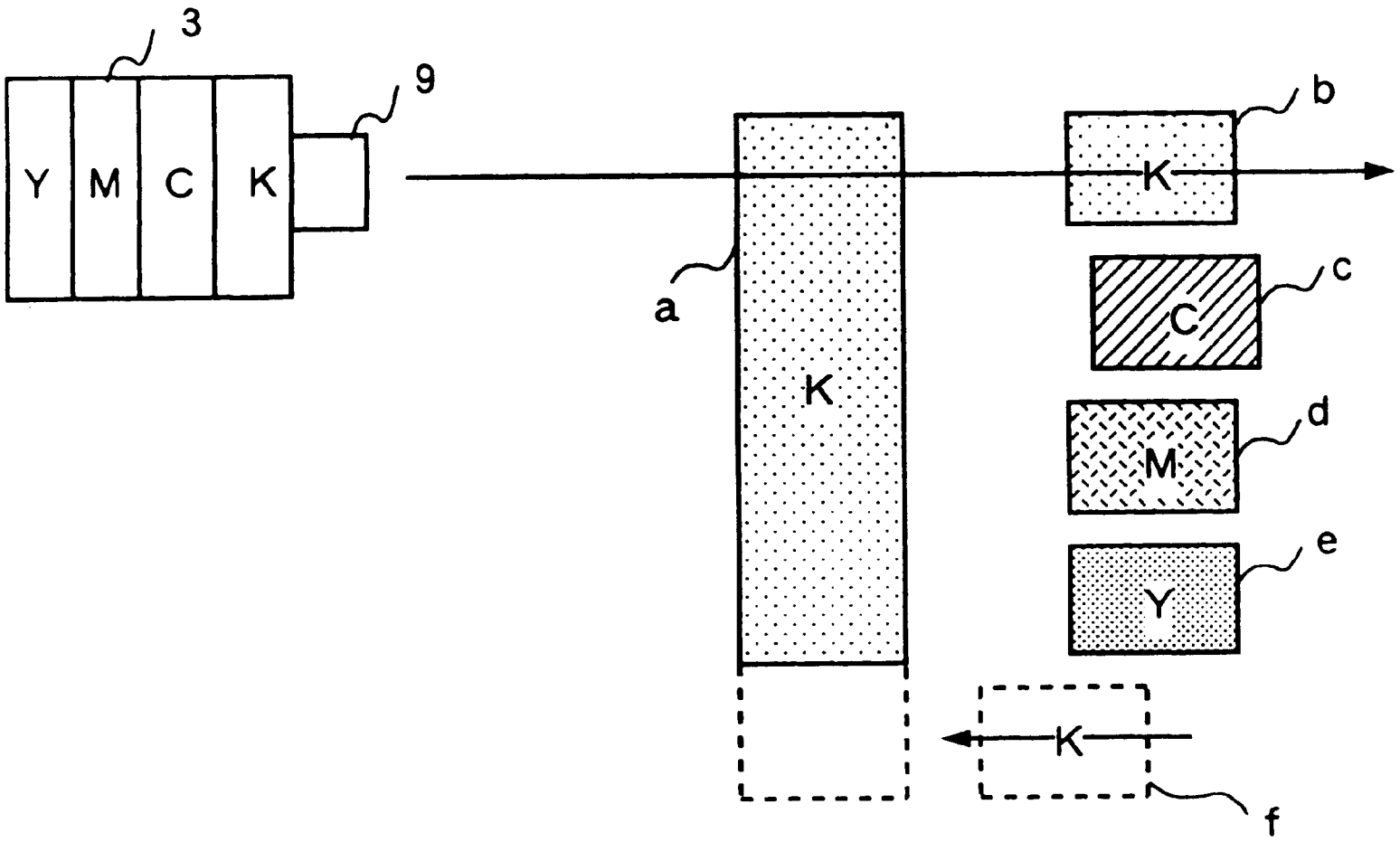
FIG. 17 shows a printed pattern for detecting registration errors due to deviation of the heads.
Figure 18B:
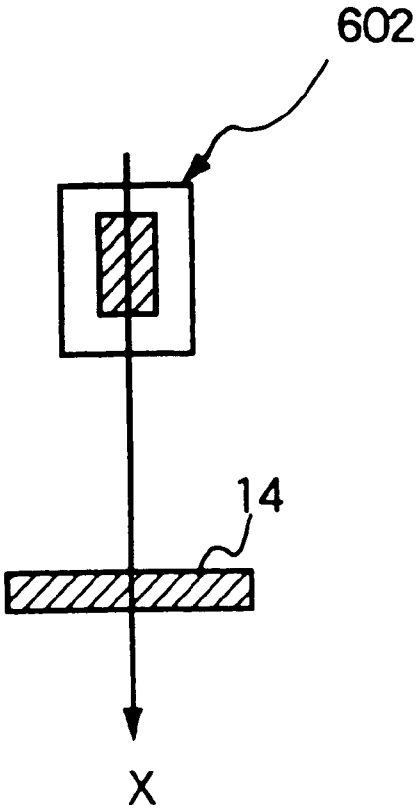
FIGS. 18(*a*) and 18(*b*) show a configuration of a sensor for detecting registration errors in the prior art.
Figure 18A:
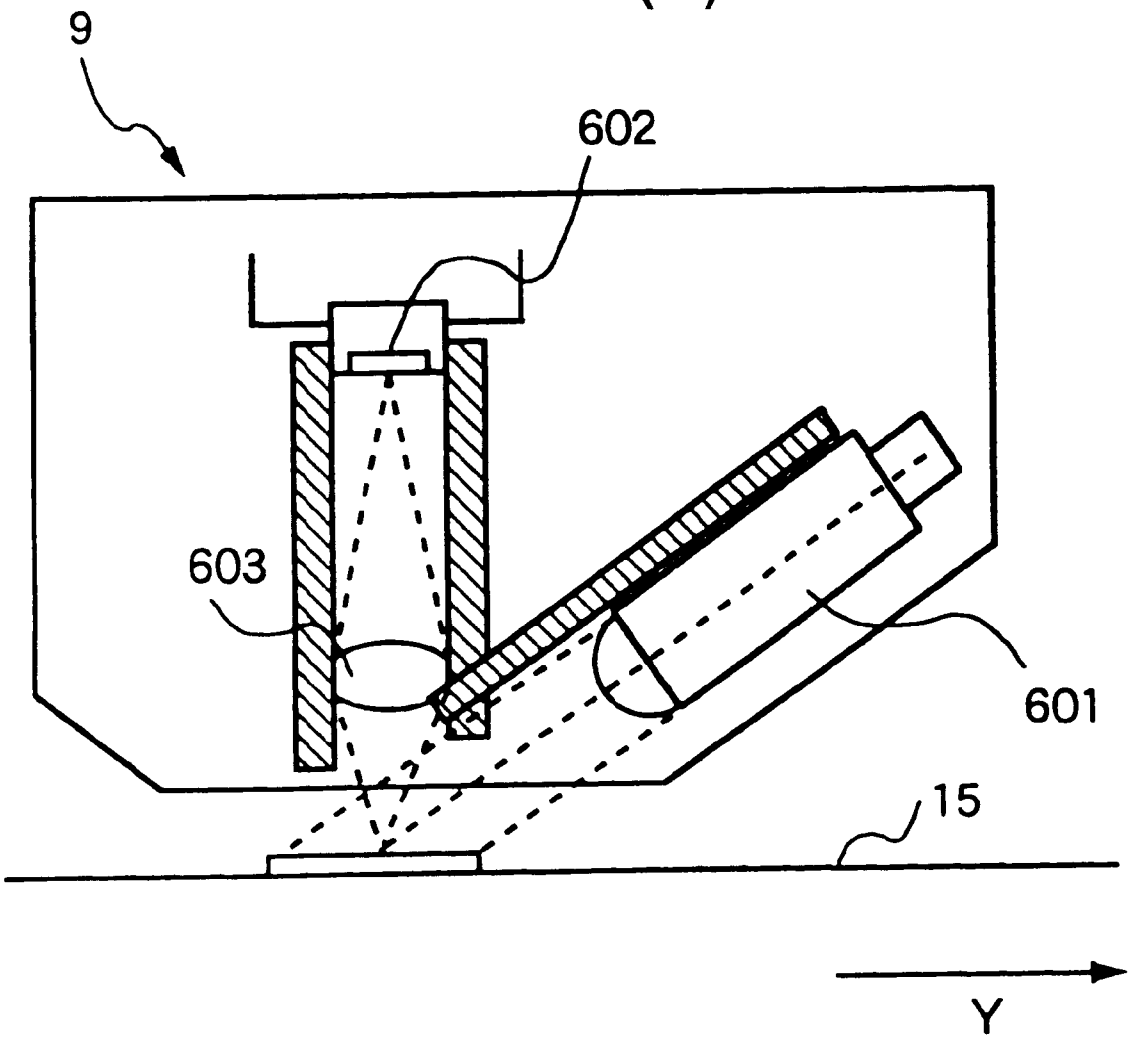
Figure 19:
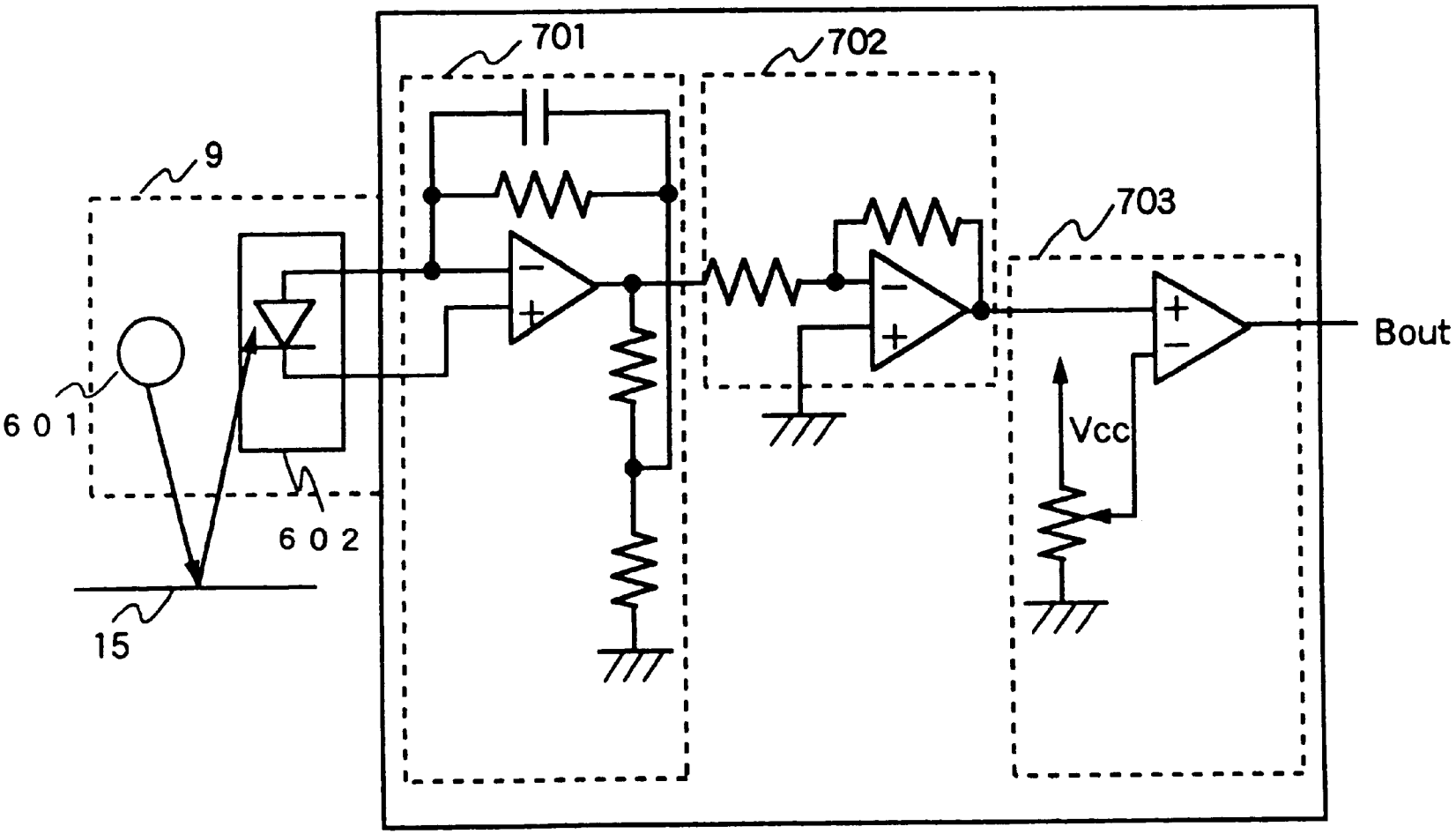
FIG. 19 shows a configuration of a circuit for processing an output from the sensor in the prior art.
Figure 20:
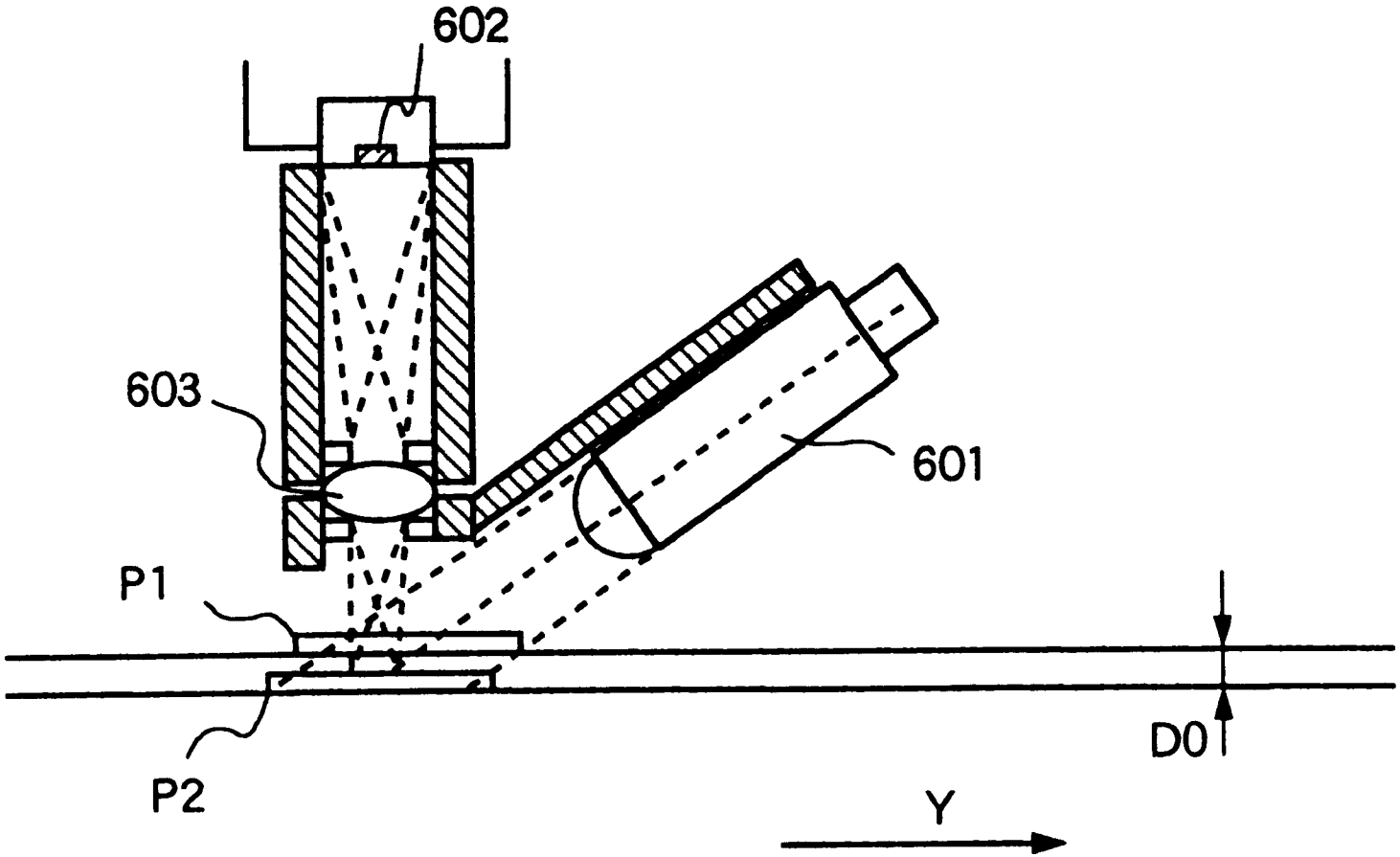
FIG. 20 shows a change in light-illuminated position relative to the sensor in the prior art.
Figure 21A:
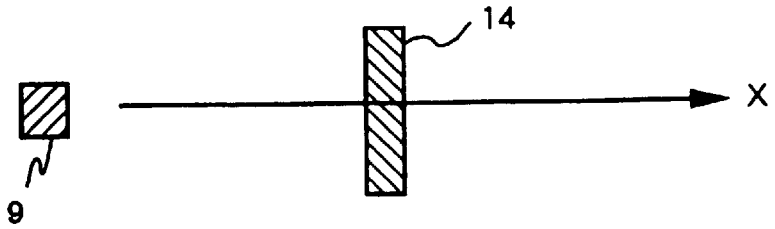
FIGS. 21(*a*) and 21(*b*) show processing waveforms which are obtained when an output from the prior art sensor is processed.
Figure 21B:
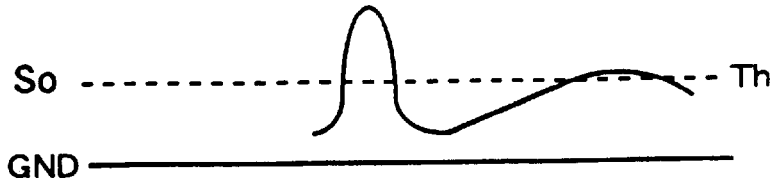
Figure 21C:
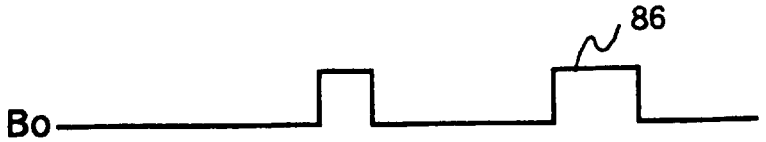
Figure 21D:
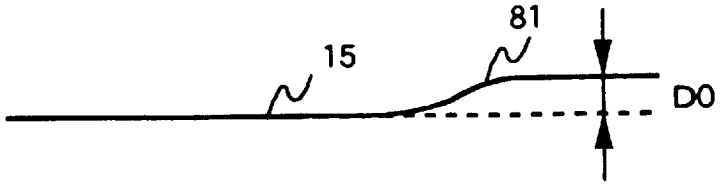

An upper-cover open/close detection sensor 10 is mounted on the main body of the device. When the upper cover 12 is opened, heads 3 are exchanged, and then the upper cover 12 is closed again, an operation is started to detect the registration errors. Alternatively, this operation may be commanded with an operation key (not shown) pressed by a user. In the operation, first, a print pattern (test pattern) as shown in FIG. 17 mentioned above is automatically printed. In this embodiment, the width of each region of the print pattern along the scanning direction of the sensor 9 is, for example, a few millimeters. The data of this print pattern is prestored in the ROM 18. Then, after printing the print pattern, the sensor 9 mounted adjacent to the heads starts to read the printed pattern to detect the registration errors.

Incidentally, in FIG. 2, M1 indicates a motor for moving the carriage in the X direction and M2 indicates a motor for traveling the paper sheet 15 in the Y direction.

In this embodiment, the sensor 9 is mounted on the carriage which carries the heads thereon. However, the sensor 9 may be provided separately from the carriage.

Figure 3:
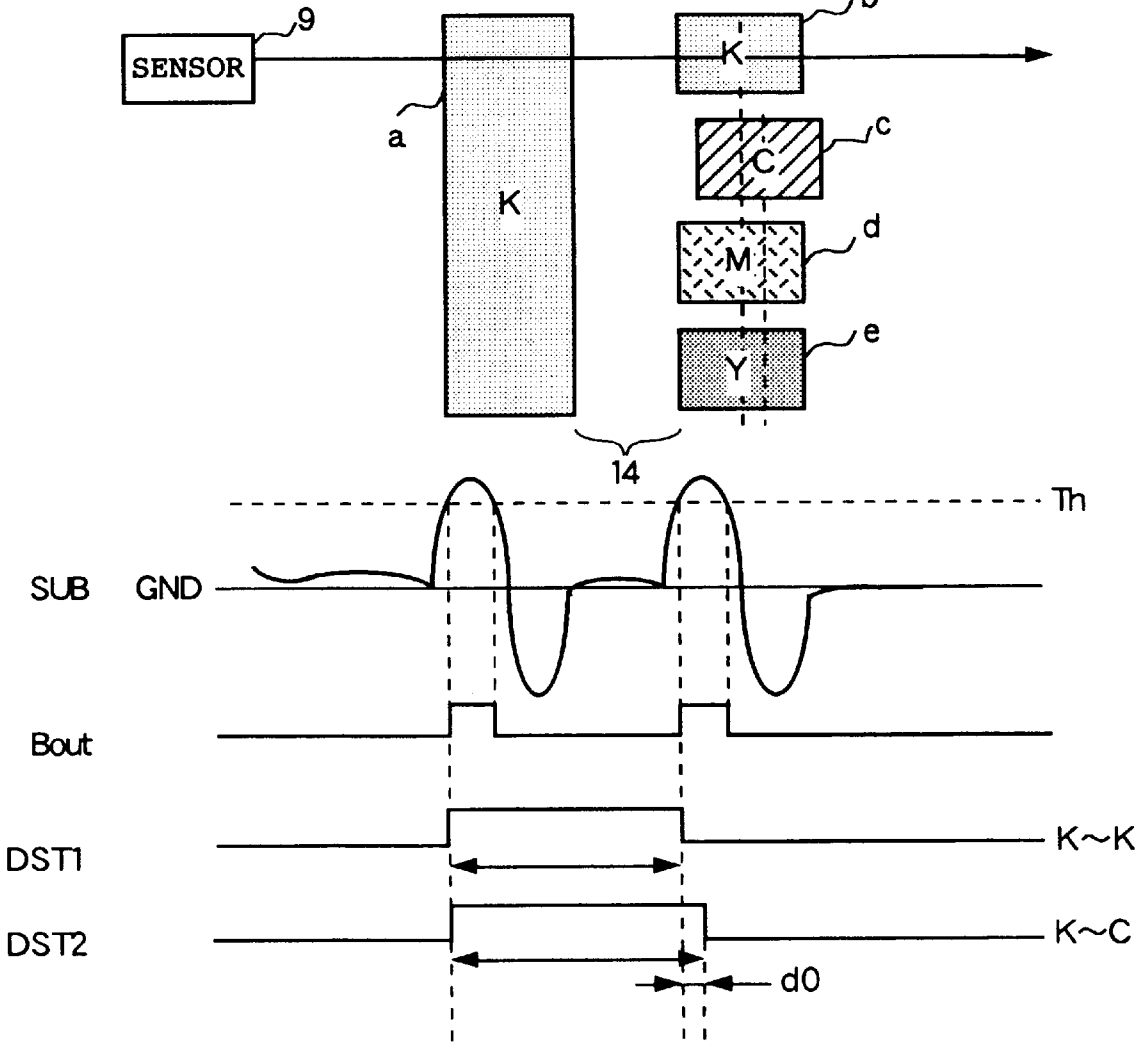
FIG. 3 is a diagram for explaining a method for processing signals in the embodiment.

Referring next to FIG. 3, an explanation will be given of an operation of the registration error detection in detail.

First, the sensor 9 scans the regions a and b of the pattern, so that a difference signal SUB of the outputs from the two light receiving elements of the sensor 9 is converted into a bi-level digital signal Bout with a particular threshold voltage Th in the pattern detection unit 6 of the print control unit 2. Based on the bi-level signal Bout, a distance DST between the two regions is obtained in the registration error detection unit 7. The distance DST1 between the regions a and b is obtained by counting reference clock CLK during a time from a leading edge of the bi-level signal output Bout, derived from the scanning of the regions a and b, to the subsequent leading edge of the same. With a higher frequency of the reference clock, the registration errors can be detected with a higher resolution. Similar operation is performed with respect to the region a and c so as to obtain a distance DST 2. Further, likewise, each distance between respective two regions is obtained with respect to regions a and d, and regions a and e. With these data obtained, it is possible to obtain, with the data of the regions a and b used as a reference, differences (d0) between the respective data so as to calculate to what extent each head is misaligned relative to a reference head. The sign (plus or minus) of the difference d0 shows in which direction the head is shifted, left or right, with respect to the head of the reference color.

The configuration and operation for detecting a pattern are the most characteristic part of the present invention, and hence, will now be described below in detail.

Figure 4B:
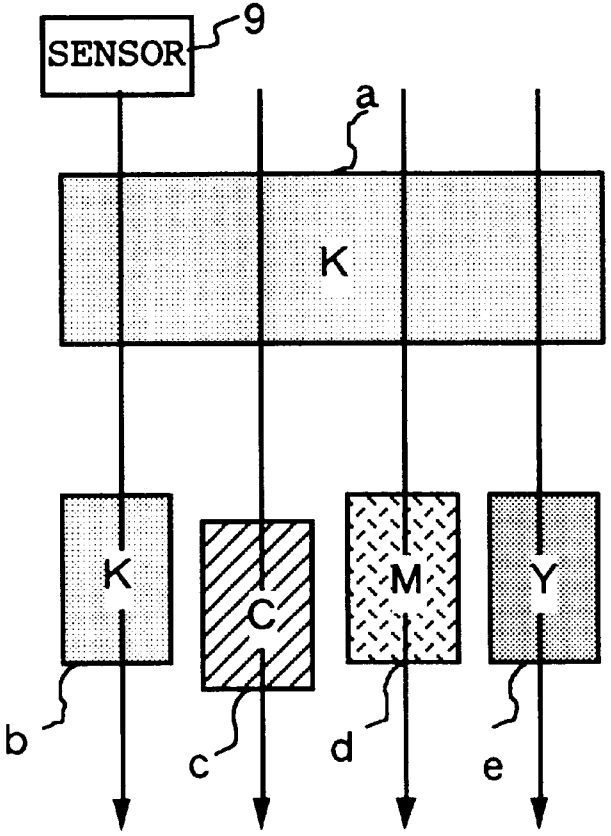
FIGS. 4(*a*) and 4(*b*) are diagrams for explaining a method for detecting printed patterns in the embodiment, with a case (a) for detecting lateral registration errors and a case (b) for detecting vertical registration errors.
Figure 4A:
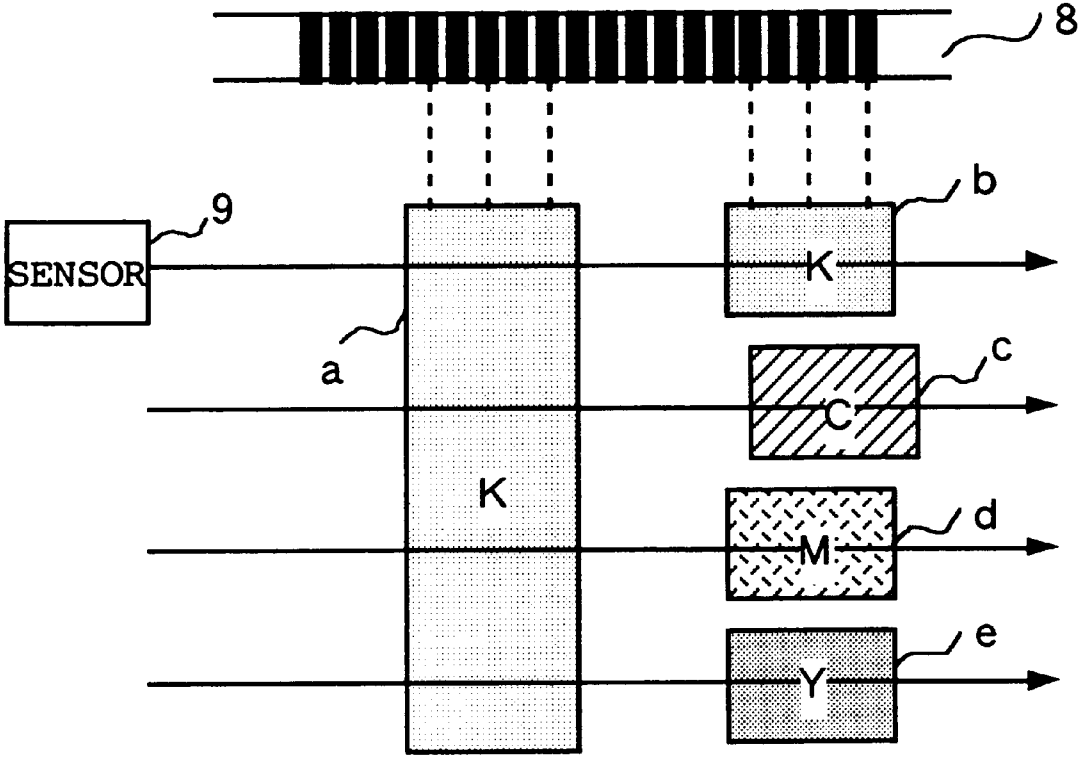

Referring first to FIGS. 4 (*a*) and (*b*), the pattern will be explained. In FIG. 4(*a*), regions a and b (referred to as regions a/b hereinafter) are printed with a reference one of the heads and regions c/d/e are printed with other heads. In this example, the head with a black ink container is used as the reference. In order to align other heads equipped with other color ink containers, with the reference head, the regions a/b are printed with the head of the black ink container, the region c with cyan ink, the region d with magenta, and the region e with yellow.

In FIG. 4(*a*), the region c is illustrated misaligned with the regions b/d/e. This shows an aspect where the regions were intended to be printed at the same reference column, but the printed result ended in the misalined printing due to the lateral shift of a head.

Thus, a pattern for detecting a lateral registration errors is shown in FIG. 4(*a*), and a pattern for detecting a vertical registration errors is shown in FIG. 4(*b*).

After printing such printing patterns, with respect to the pattern for detecting the lateral registration errors the carriage mounting the sensor 9 is moved in a main-scanning direction to read the printed pattern. With respect to the pattern for detecting the vertical registration errors, the sensor 9 is moved over the printed pattern and then a paper sheet is travelled in a sub-scanning direction to read the printed pattern.

In order to detect a printing error in the case of the two-way printing, an additional region f may be provided as shown in FIG. 17.

Figure 5B:
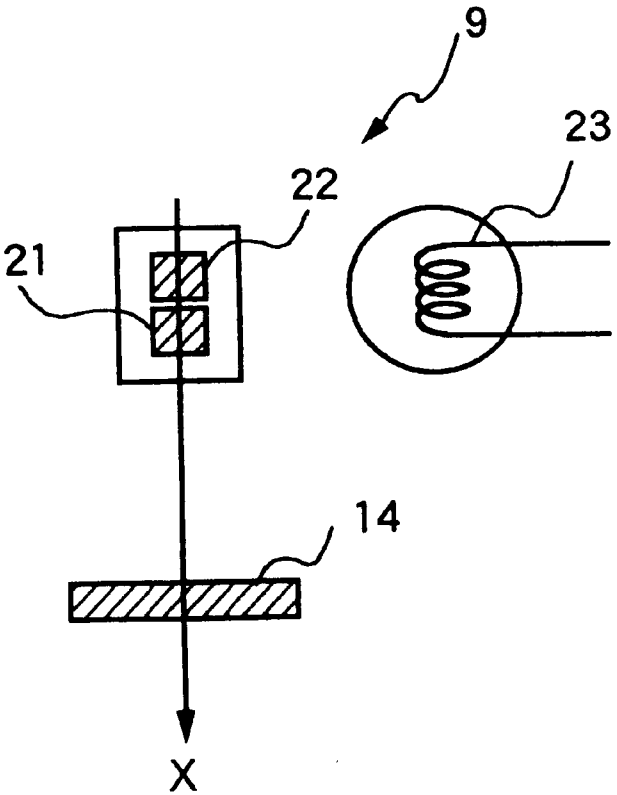
FIGS. 5(*a*) and 5(*b*) show a configuration of a sensor with its side view (a) and plan view (b)
Figure 5A:
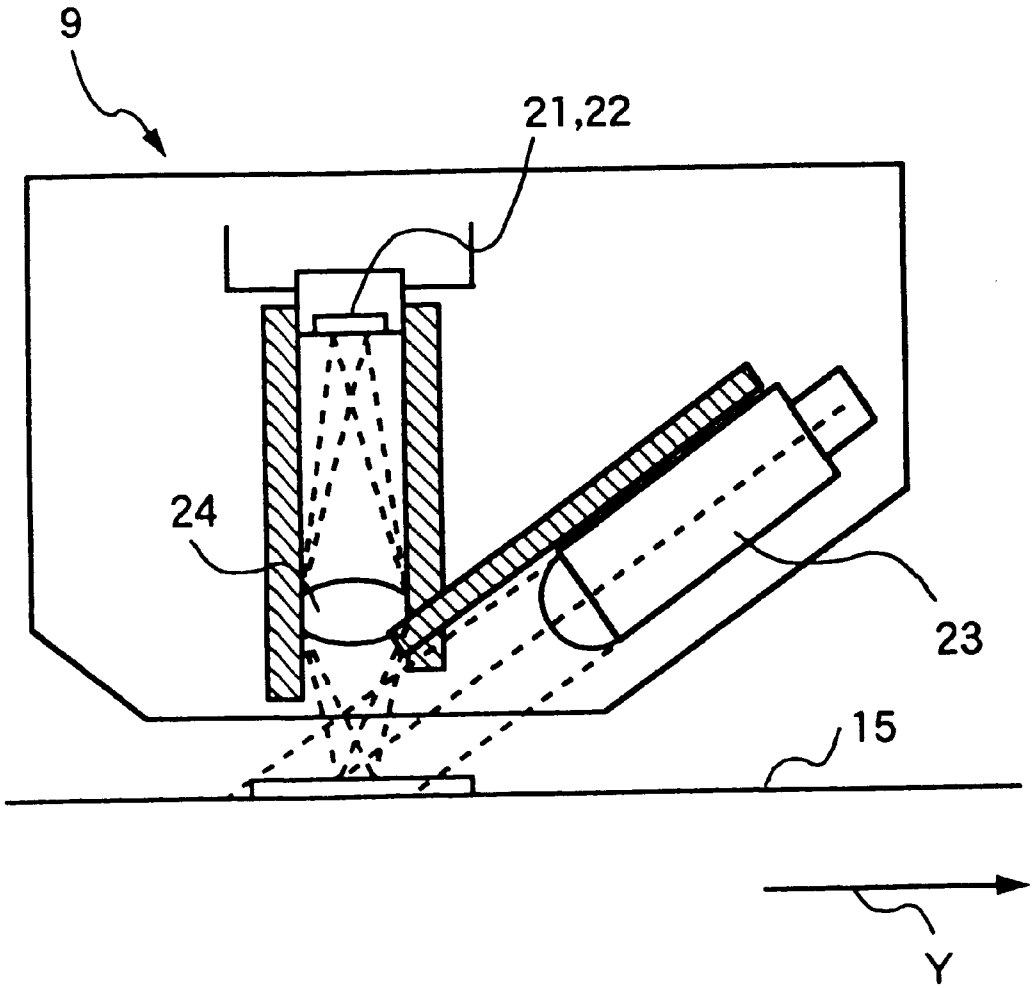

Referring next to FIGS. 5 (*a*), (*b*) and 6, an explanation will be given of the configuration and operation of the sensor 9.

FIGS 5 (*a*), (*b*) shows an internal configuration of the sensor 9 which includes first and second light receiving elements 21 and 22, a light emitting element 23, a lens 24, etc. As shown in FIG. 5(*b*), the first and second light receiving elements 21 and 22 are equally spaced from the light emitting element 23 and disposed adjacent to each other in the carriage moving direction X (main-scanning direction). In this case, the fist and second light receiving elements are constituted by a two-divided photodiode, but alternatively two photodiodes of a normal one-chip type may be used.

Figure 6:
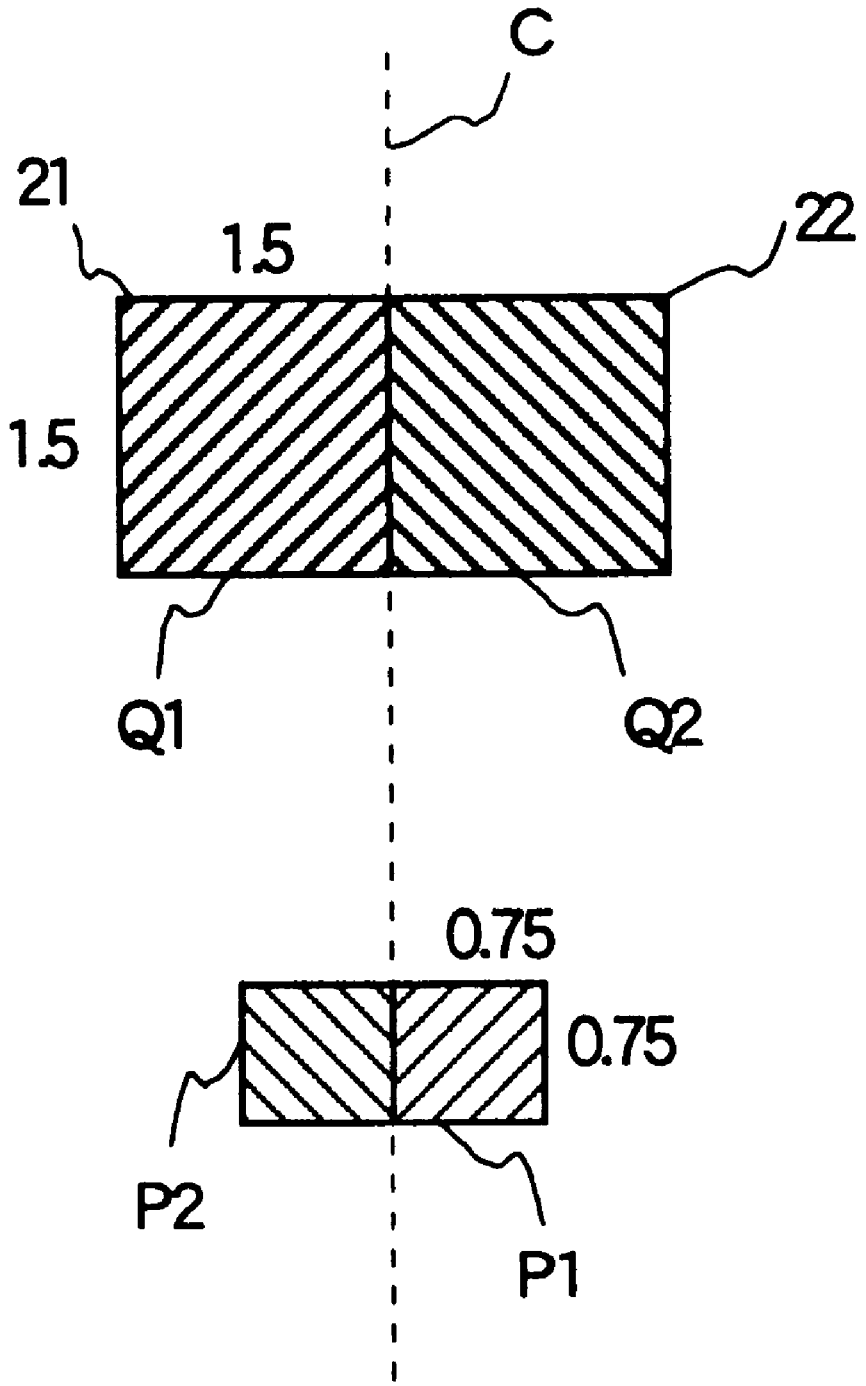
FIG. 6 is a diagram showing the relationship between a reflecting area on a paper sheet, which reflects light and is monitored by the sensor shown in FIG. 5, and a light receiving area of a light receiving element.

Also, in this case, a lens of a 5 mm diameter is used and disposed so that the image printed on a paper sheet is focused with a doubled size on each of the light receiving elements 21, 22. In addition, as shown in FIG. 6, a light receiving area (hatched in Figure) of each of the light receiving elements 21, 22 is 1.5 mm×1.5 mm in size. The light receiving elements 21 and 22 receive reflected light from the respective areas each of 0.75 mm×0.75 mm with a border of a center C disposed therebetween. (That is, the reflected light from an area P1 is received at an area Q1 while similarly the reflected light from an area P2 is received at an area Q2.) Therefore, in this configuration, an area of 1.5 mm×0.75 mm in total (i.e., area P1+area P2) is monitored by the two light receiving elements 21 and 22.

The outputs from the light receiving elements 21, 22 which have read the pattern on a paper sheet will be processed at the pattern detection unit 6 (see FIG. 1) to detect portions at which the intensity changes depending upon the pattern.

Figure 7:
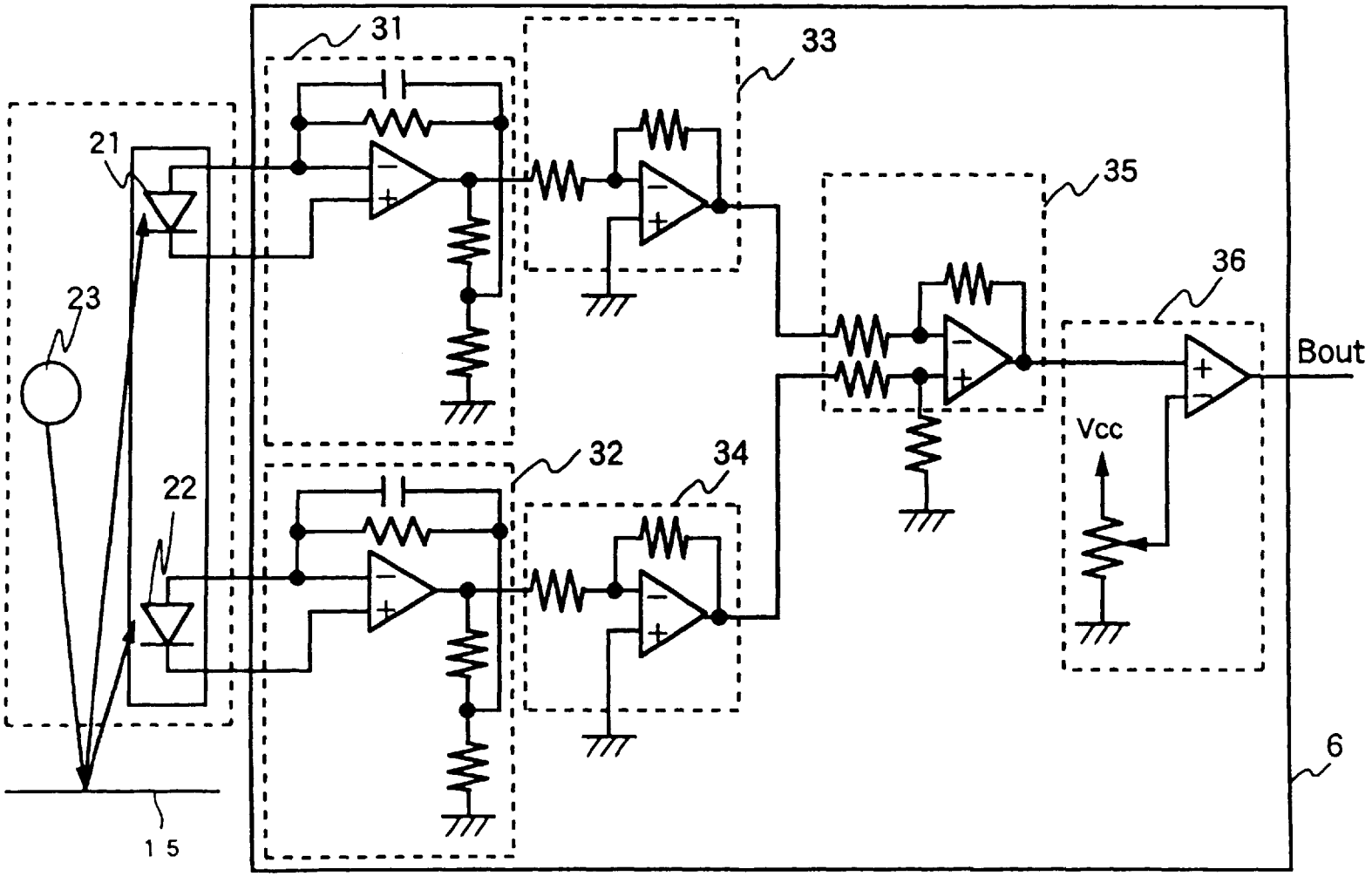
FIG. 7 shows an internal configuration of the pattern detection unit in the embodiment.
Figures 8A, 8B, 8C, 8D, 8E:
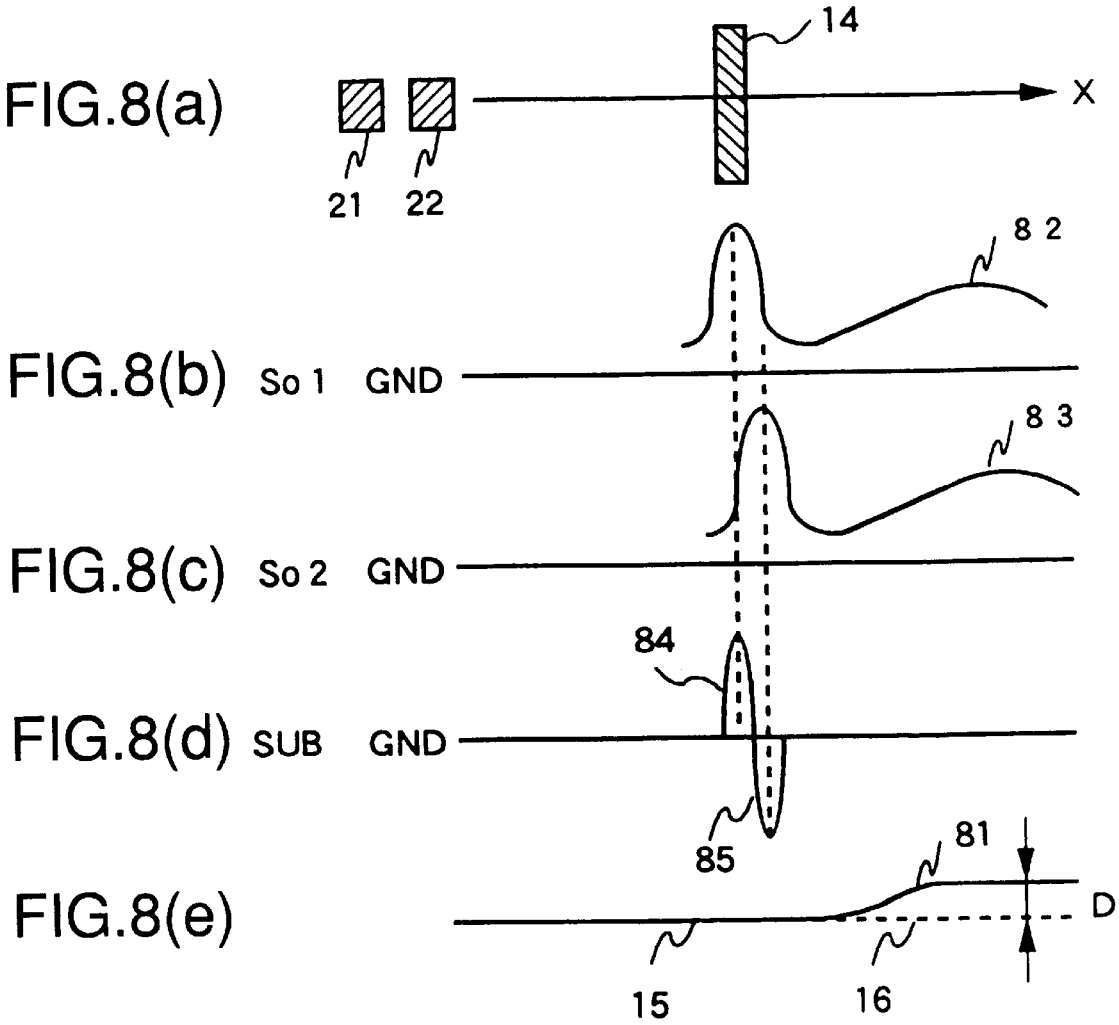
FIGS. 8(*a*)–8(*e*) comprise a diagram for explaining an example of detecting a printed region by the sensor in the embodiment.

A detailed configuration of the pattern detection unit 6 is shown in FIG. 7 and its operation waveforms are shown in FIG. 8.

In FIG. 7, numerals 31 and 32 each indicate a current amplifier circuit, numerals 33 and 34 each indicate an inverting amplifier circuit, a numeral 35 indicates a differential amplifier circuit, and a numeral 36 indicates a comparator. As previously explained, the light receiving elements 21 and 22 are placed at a distance from each other. Therefore, the outputs from the respective light receiving elements 21 and 22 which have read the pattern on a paper sheet will vary with a difference in time as shown in FIGS. 8 (*b*) and (*c*). (This time difference depends upon the moving speed of the sensor 9.) In this example, photodiodes are used as the light receiving elements, and the output waveforms shown in FIGS. 8 (*b*) and (*c*) represent the current-to-voltage converted outputs from the current amplifier circuits 31 and 32 of FIG. 7 that convert variation in currents, which are generated in the photodiodes in response to light variations, into voltages when the pattern is read.

In addition, as mentioned above, the output from the light receiving elements 21 and 22 are at a faint level, and hence, the current-to-voltage converted outputs from the amplifier circuits 31 and 32 are further amplified at the inverting amplifier circuits 33 and 34, one outputs of which is then subtracted from the other at the differential amplifier circuit 35.

As shown in FIG. 8 (*d*), the subtracted output SUB varies only at the portions where the printed pattern is present, centered at a reference level (GND). Further, as stated above, the two light receiving elements 21 and 22 receive the light reflected from the area of 1.5 mm×0.75 mm on a paper sheet where the floating amount of the paper sheet has no substantial change within the area (because the area is small). For this reason, even if the paper sheet floats, the resultant change in the output will be very slow. Thus, when the output of the light receiving element 21 is subtracted from that of the light receiving element 22, the outputs will cancel at the floating portions (see FIGS. 8(*b*), (*c*) and (*d*)). On the other hand, the first and output peaks corresponding to the printed pattern will remain even after the subtraction, in the form of a positive peak 84 and a negative peak 85 (see FIG. 8 (*d*)). This is because the light receiving elements are disposed spaced apart from each other in the carriage-moving direction and because the outputs corresponding to the printed pattern regions change abruptly. Thus, the portions of the printed pattern regions can be accurately detected notwithstanding the presence of the paper sheet floating.

Figure 22:
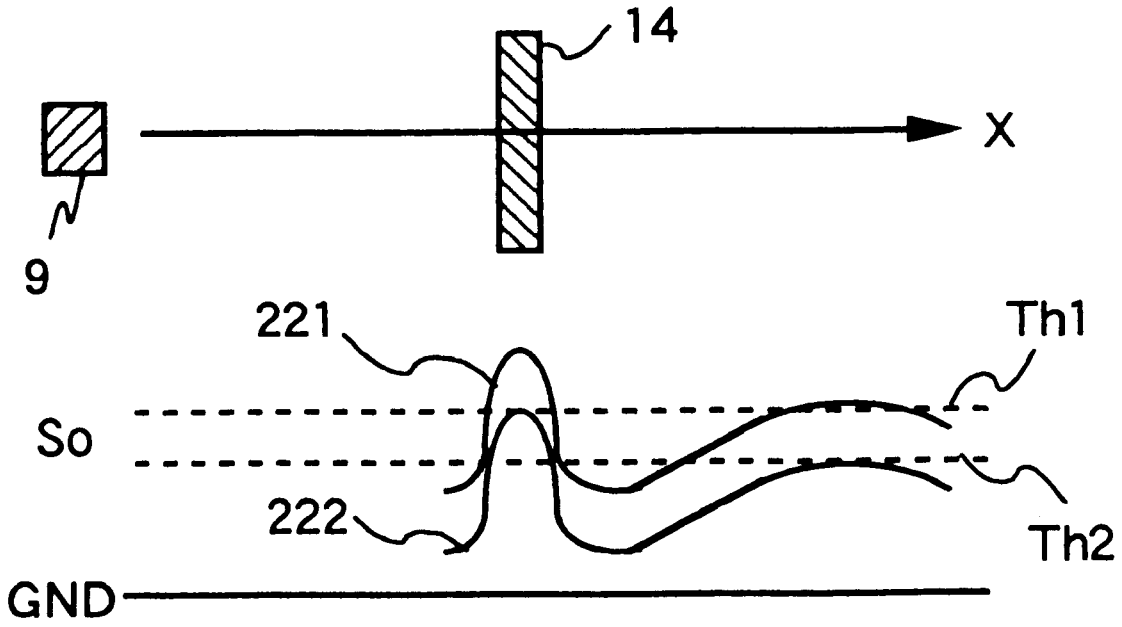
FIG. 22 shows outputs from the sensor which are obtained when reading printed patterns on papers sheets of difference reflectances.

In addition, some users may use a paper sheet of a low reflectance such as the intermediate paper. In this case, as pointed out above, it could be impossible to perform the bi-level conversion. As seen from FIG. 22, the sensor output of a paper sheet of a lower reflectance has a lower DC level than that of a paper sheet of a higher reflectance, but their changing components are substantially maintained. This enables the output changing only at the portions corresponding to the pattern regions, centered at the reference level (GND) (see FIG. 8 (*d*)), when performing the subtraction between the outputs of the light receiving elements 21 and 22, by the use of the same means as described above. Accordingly, it is possible to accurately detect printed pattern regions even when the printed pattern is formed on a paper sheet of a low reflectance.

In this way, with a couple of light receiving elements to calculate the difference between their outputs, the subtracted output changes only at the portions corresponding to the printed pattern regions so that a bi-level conversion can be performed with a fixed threshold level as described below. The output of the differential amplifier circuit 35 is compared, at the comparator 36, with a predetermined threshold level to be converted into a bi-level digital data, which in turn are digitally processed at the registration error detection unit 7 to detect registration errors.

Figure 9B:
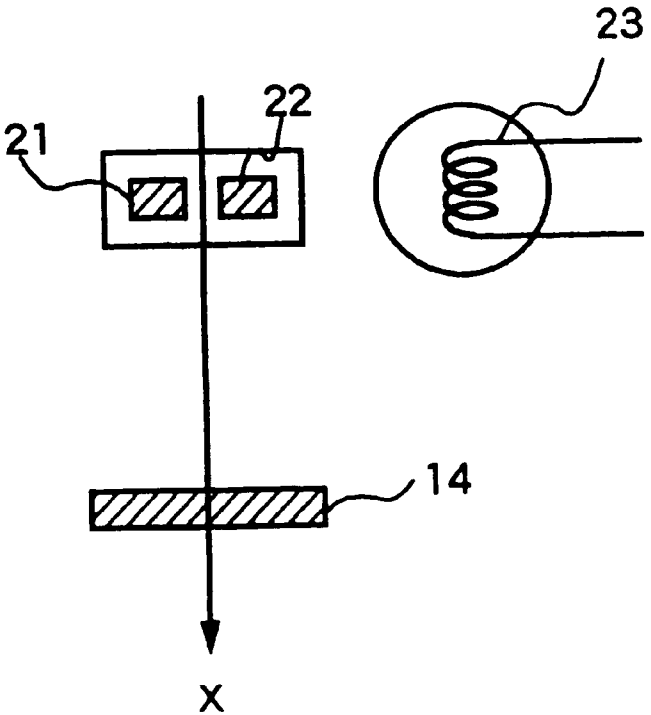
FIGS. 9(*a*) and 9(*b*) show a change in light-illuminated position relative to the sensor of the embodiment when a floating of a paper sheet occurs, with its side view (a) and plan view (b)
Figure 9A:
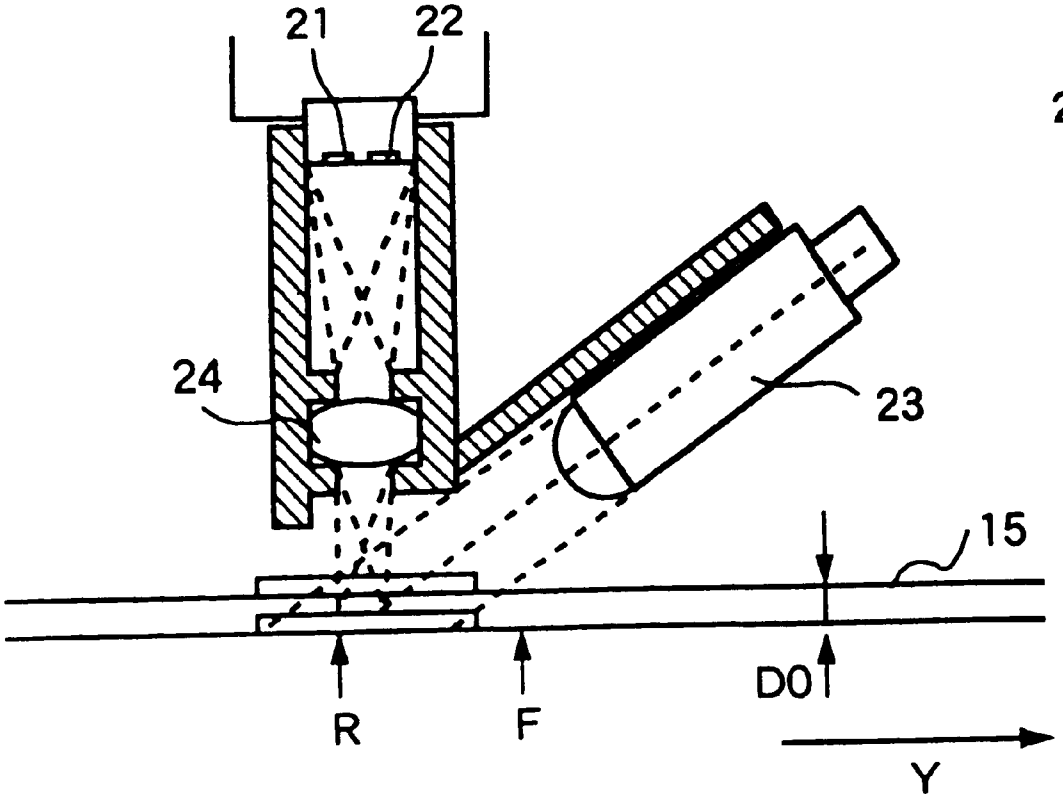

As mentioned above, the two light receiving elements 21 and 22 are disposed at the same distance from the light emitting element 23. As shown in FIGS. 9 (*a*) and (*b*), floating of a paper sheet will change the position illuminated by the light emitting element 23 so that the front side F of the sheet nearer the light emitting element 23 become brighter than the rear side R. This will change the amount of light incident into the respective light receiving elements 21,22, causing a significant change in the subtracted output. To overcome this problem, the light receiving elements 21, 22 are disposed at the same distance from the light emitting element 23, as previously mentioned. This assures that when the outputs of the light receiving elements 21 and 22 change because of the paper sheet floating, they change equally so that the changes are cancelled in the subtracted output.

Figure 10:
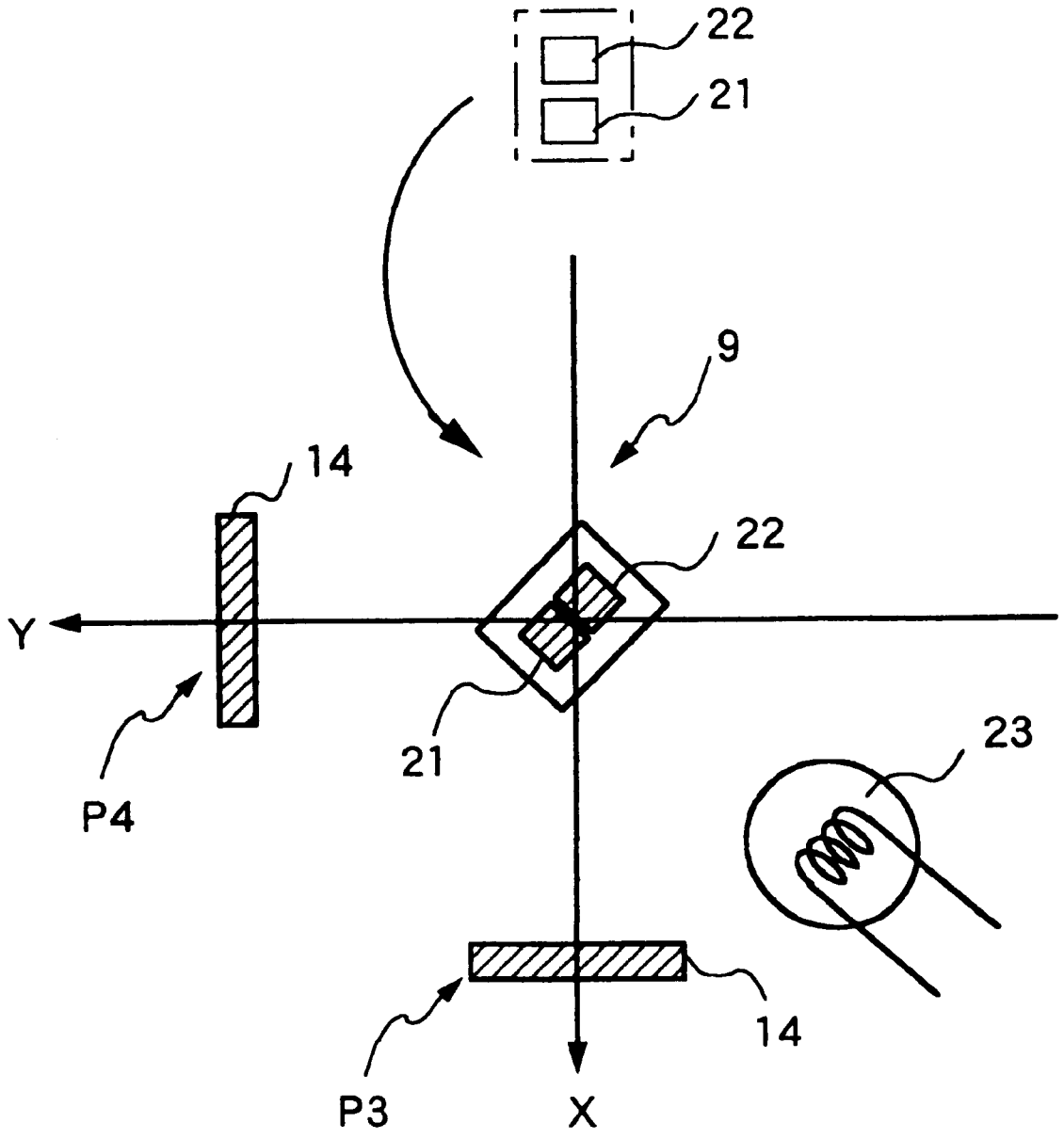
FIG. 10 shows an arrangement of the sensor, inclined at a predetermined angle.
Figure 11:
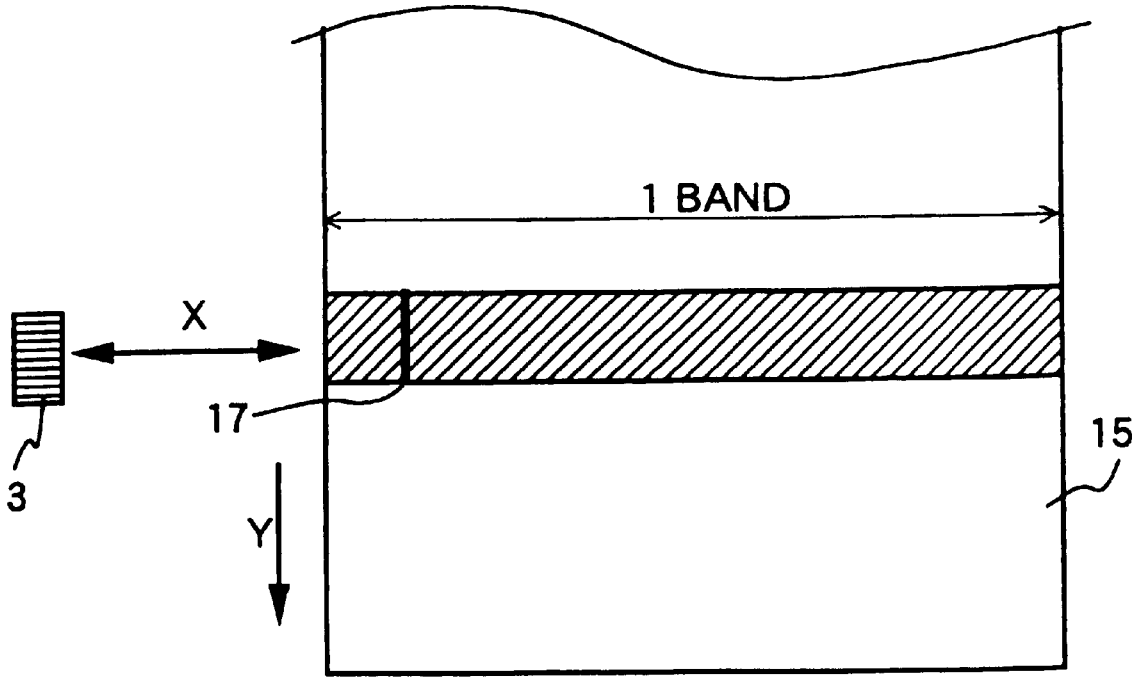
FIG. 11 shows an example of a band which is printed by the heads according to a prior art ink type image forming device.
Figure 12:
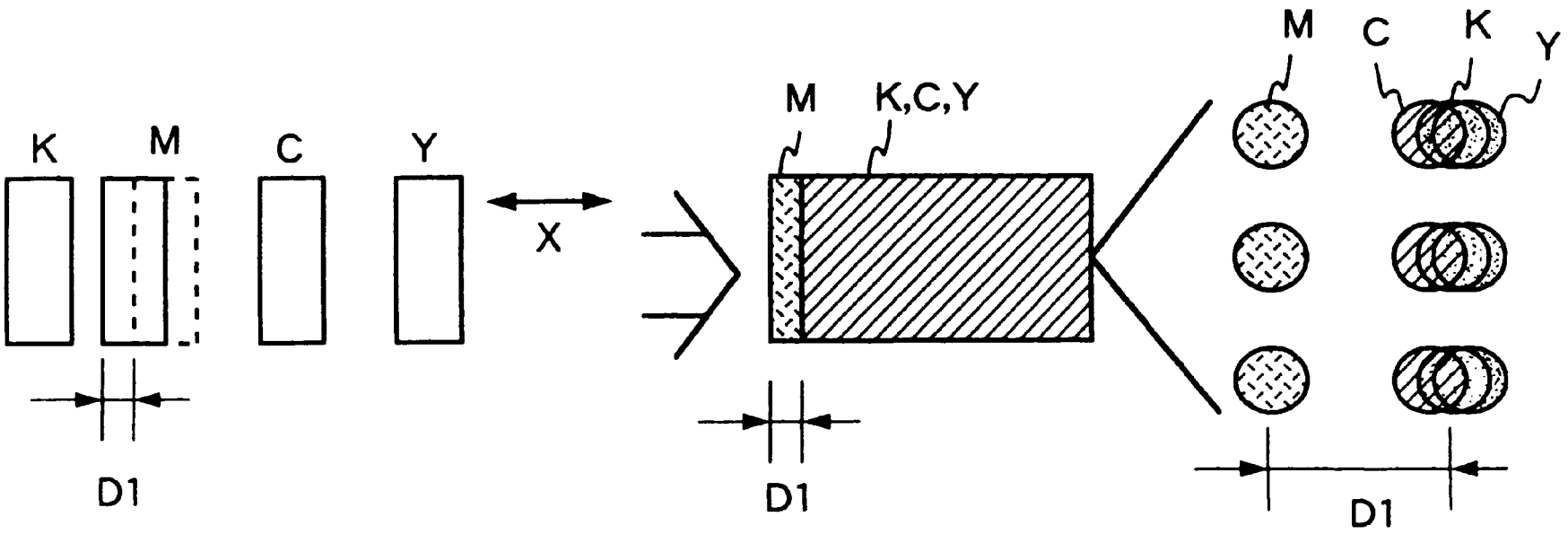
FIG. 12 is a diagram for explaining a printed result in a case where one head is laterally misaligned relative to other heads in the prior art.
Figure 13:
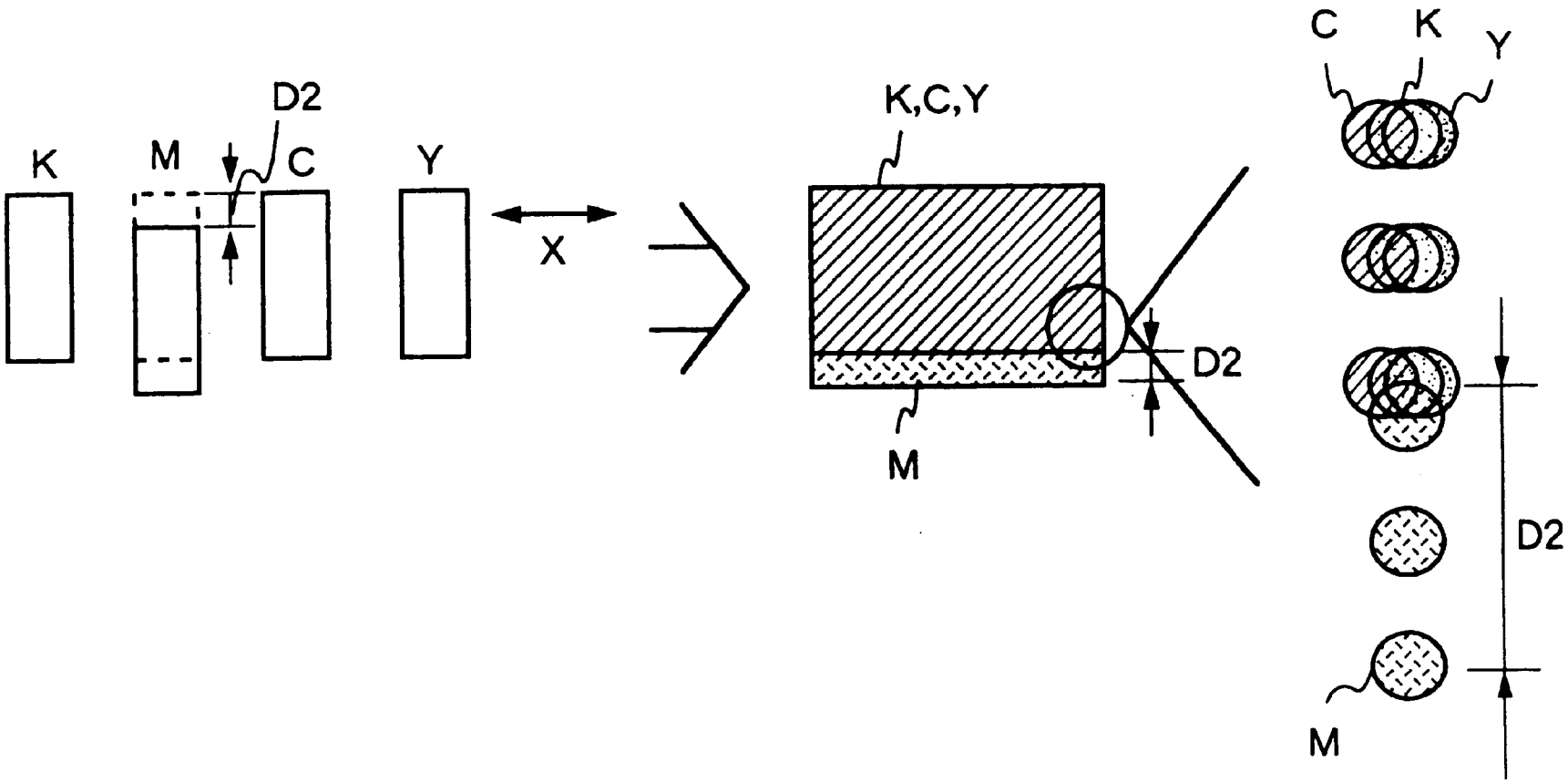
FIG. 13 is a diagram for explaining a printed result in a case where one head is vertically misaligned in the prior art.
Figure 14:
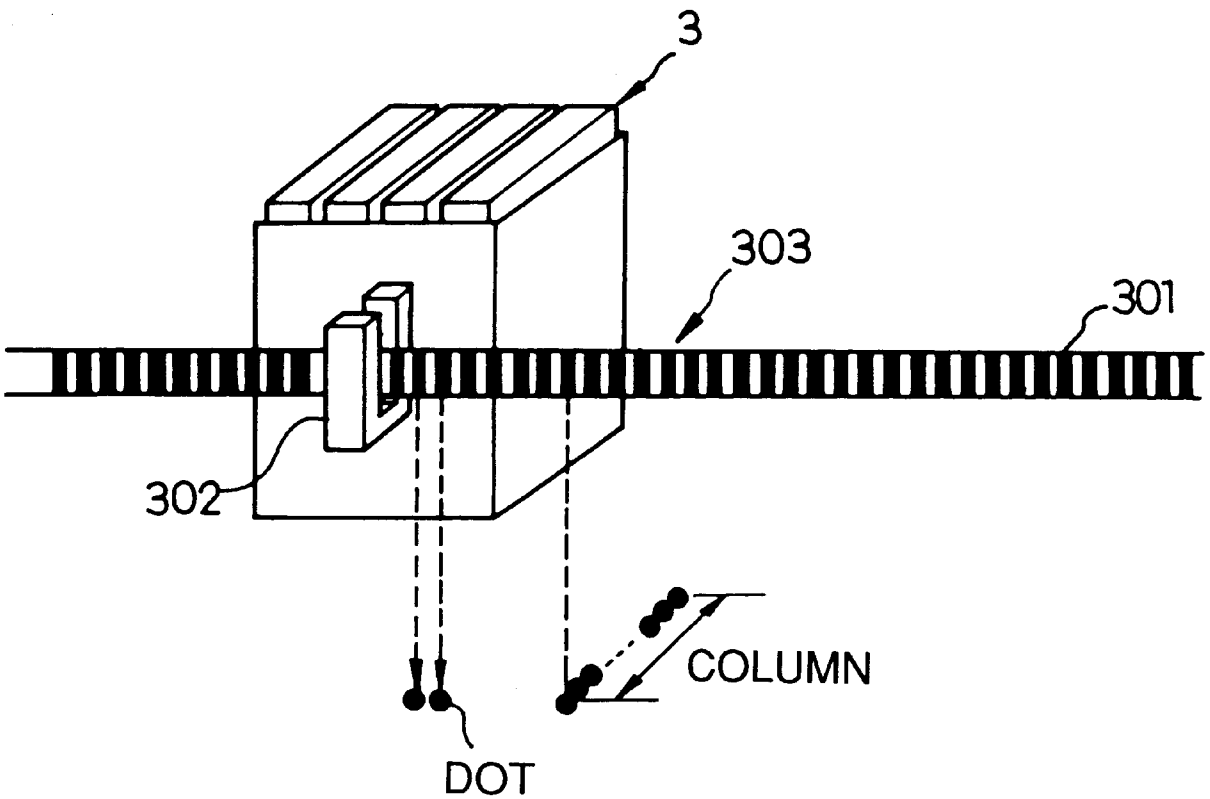
FIG. 14 is a diagram showing the relationship between the heads and a linear scale with slits.
Figures 15A, 15B:
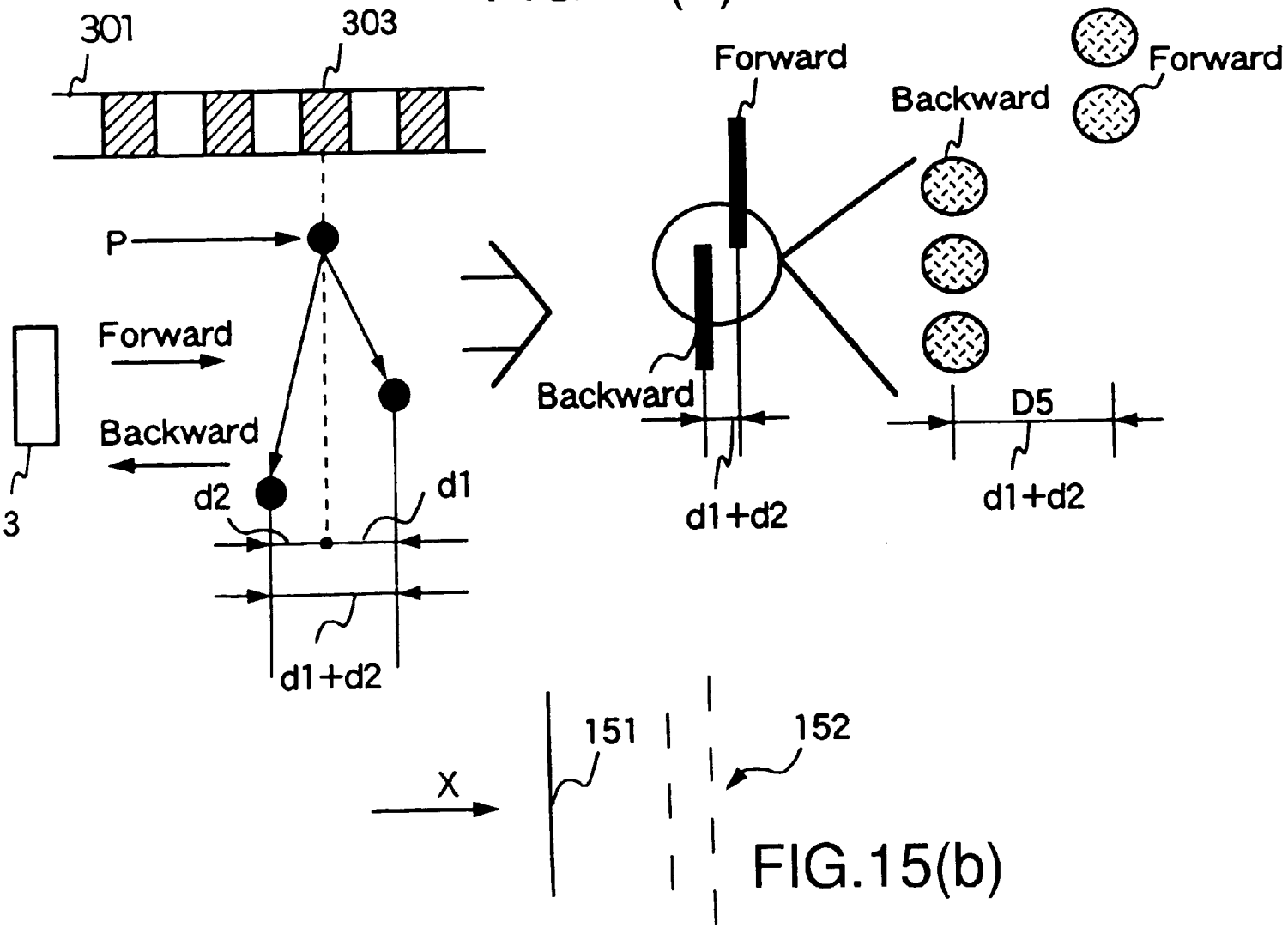
FIGS. 15(*a*) and 15(*b*) are diagrams for explaining misaligned printing in forward and backward paths when the heads are used for the bi-directional or two-way printing in the prior art, with (a) showing the doubling of positional errors due to the two-way printing and (b) showing a remarkable degradation of an image, particularly for a line drawing due to the two-way printing.
Figure 16B:
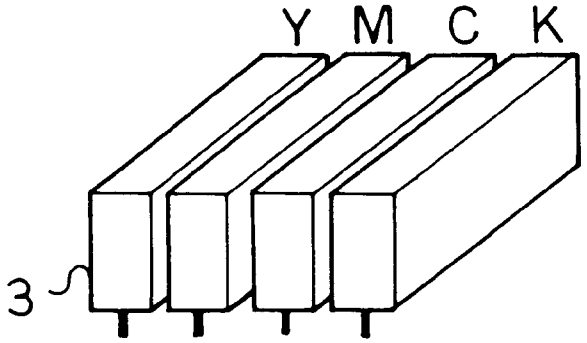
FIGS. 16(*a*) and 16(*b*) show a configuration of heads and ink containers of a separate type (a) and an integrated type (b)
Figure 16A:
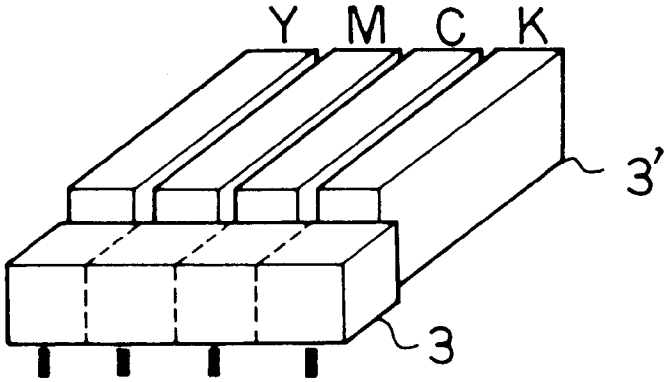

Also, as mentioned above, the first and second light receiving elements 21 and 22 are used both for reading the pattern for detecting lateral registration errors (FIG. 4 (*a*)) and the pattern for detecting vertical registration errors (FIG. 4 (*b*)). For this end, as shown in FIG. 10, the light receiving elements 21 and 22 are mounted at 45 degrees relative to the main-scanning axis (carriage-moving direction x) and sub-scanning axis (paper-travelling direction Y). The reason is as follows: If the sensor (light receiving elements 21, 22) were not tilted (the state shown in a dashed-line box), then when reading the laterally elongated region P3 (FIG. 10) the outputs from the light receiving elements 21, 22 would be successively produced with a time difference with respect to the region P3, resulting in a change of the subtracted output only at the position of the region (see FIG. 8 (*d*)). However, when reading the vertically elongated region P4 with the sensor as indicated by the dashed-line box in FIG. 10, the outputs from the light receiving elements 21, 22 would change at the same timing with respect to the region P4, resulting in no change in the subtracted output notwithstanding the presence of the printed pattern. The tilt of the sensor 9 is provided for avoiding such an inconvenience.

Now, it will be explained how the detected registration errors are used to correct the printed errors. First, regarding the correction in the lateral direction, a position instructed to eject an ink drop at is corrected by the amount of the error. For this end, a timing of ejecting the ink drop is made earlier or later depending upon the sign of the error. Alternatively, data stored in the image memory 19 may be corrected by the amount corresponding to the error. Next, regarding the correction in the vertical direction, part of the vertically aligned 128 nozzles (e.g., 120 nozzles) as mentioned above are used as effective nozzles, and these effective nozzles are selected to be displaced by the amount corresponding to the error. However, the method of correcting the printing errors, per se, is not directly related to the present invention, and methods other than that may be used.

With the above configuration and controlling method, the patterns for detecting lateral and vertical registration errors are read to accurately detect the deviations in relative position of heads with a simple control, without being affected by the paper sheet floating and the type of paper sheet, and without a complicated control of compensating for the affections.

Next, a second embodiment of the present invention will be described hereinafter.

Figure 23:
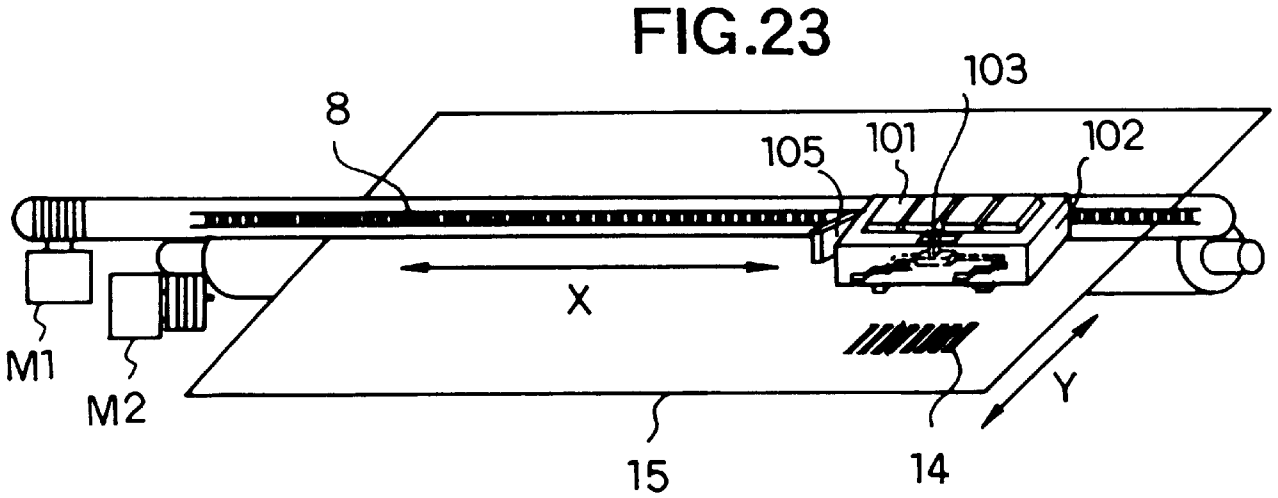
FIG. 23 shows a diagram for explaining a carriage capable of adjusting the height of the heads.
Figure 23A:
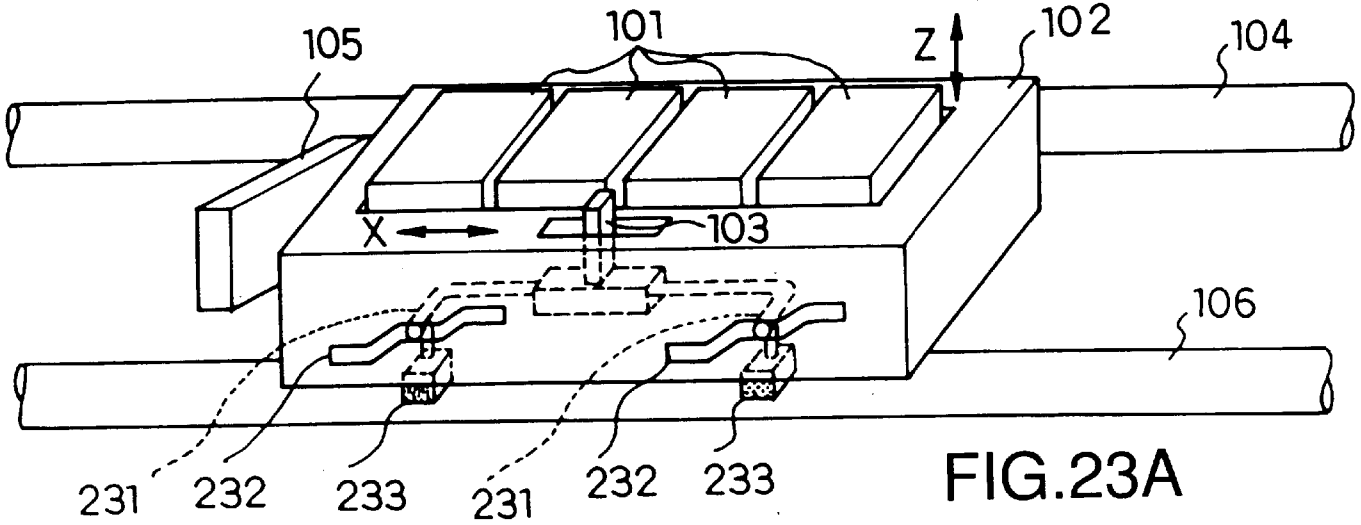

In a ink-jet recording system, a printing paper sheet absorbs ink drops during printing, which could cause the sheet to cockle depending upon the printing density or the nature of the paper sheet, affecting the part of the sheet at which the printing is being performed. In order to prevent the head scanning on the paper sheet from rasping the same due to its cockling, the carriage 102, on which a head 101 (equivalent to head 3 in the first embodiment) is mounted, is provided with a lever 103 for adjusting the height of the head, as shown in FIG. 23. Provided at the front face of the carriage 102 is stepwise slide grooves 232, in which pins 231 coupled with the lever 103 are engaged. The pins 231 are also coupled to blocks 233. When the lever 103 is moved by a user in the X direction, the ganged pins will slide within the stepwise slide grooves so as to change the height of the pins 231. This is followed by the change of the height of the blocks 233, the bottom faces of which contact the front rail 106. The carriage 102 is supported at its rear part on the rear rail 104, slidably in the X direction and pivotally about the axis of the rear rail 104. Therefore, by manipulation of the lever 103, the blocks 233 lying on the front rail 106 moves up or down, which will cause the carriage 102 to pivot about the rear rail 104, moving the head upward or downward in the Z direction. Such a configuration allows a user to adjust the height of the head 101, and hence, the distance between the head and the paper sheet, in a plurality of steps (here, three steps).

Such a head adjusting mechanism is disclosed in Applicant's Japanese patent application 8-36772 filed Feb. 23, 1996.

In the configuration shown in FIG. 23, the sensor 105 (equivalent to the sensor 9 in the first embodiment) will be lifted up similarly with a lift-up of the head 101 because the sensor 105 is fixed to the carriage 102.

Figure 24A:
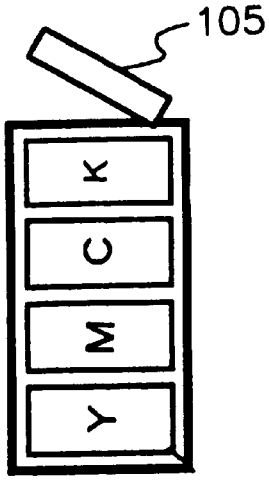
FIGS. 24(*a*) and 24(*b*) show an arrangement of the sensor shown in FIG. 23.
Figure 24B:
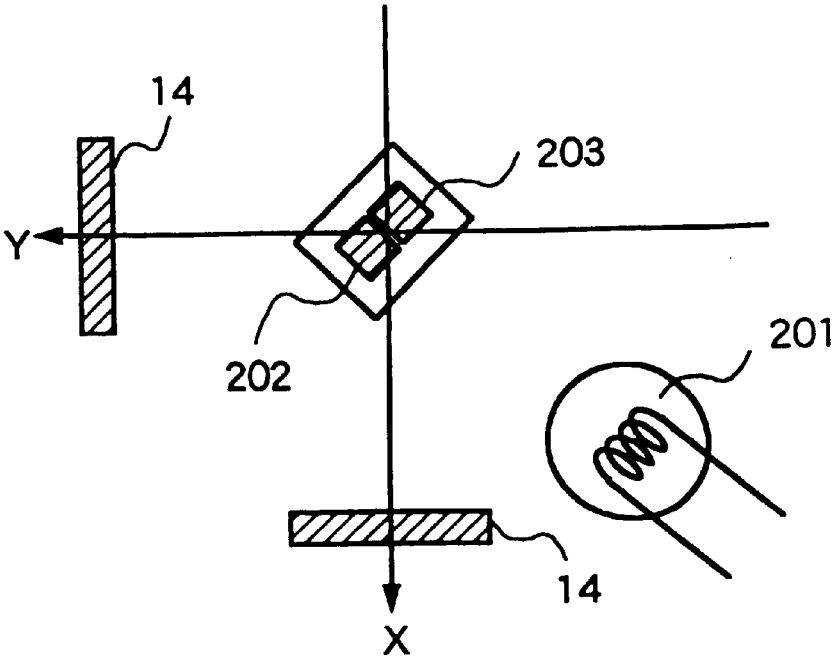
Figure 25:
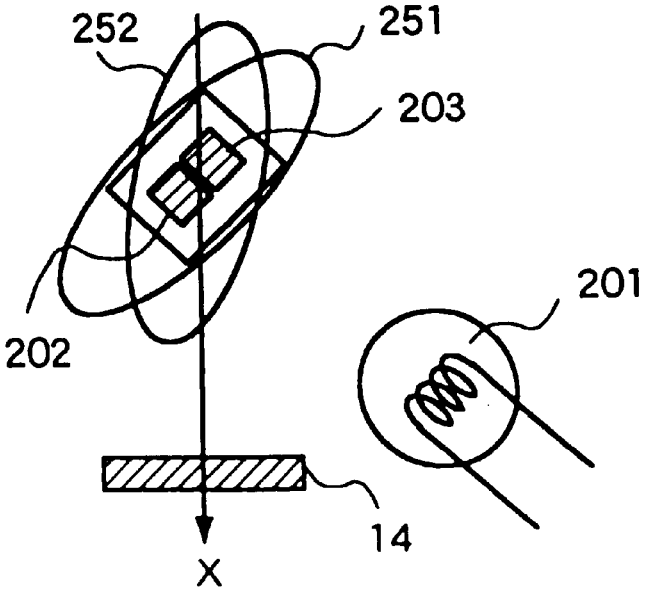
FIG. 25 shows the relationship between the sensor and associated light spots on a paper sheet when the head height is changed with the configuration shown in FIG. 23.

As shown in FIG. 24, in order to equalize the change in the incident lights to the light receiving elements 202, 203 depending upon the change in illuminated position by the light emitting element 201 when a paper sheet floats, the light receiving elements 202 and 203 are disposed at the same distance from the light emitting element. At the same time, the sensor 105 itself is tilted such that the light receiving elements 202 and 203 are aligned at an angle of 40 degrees with respect to the main-scanning direction (X) and the sub-scanning direction (Y). This is the same as in the first embodiment explained with reference to FIG. 10.

Figure 26:
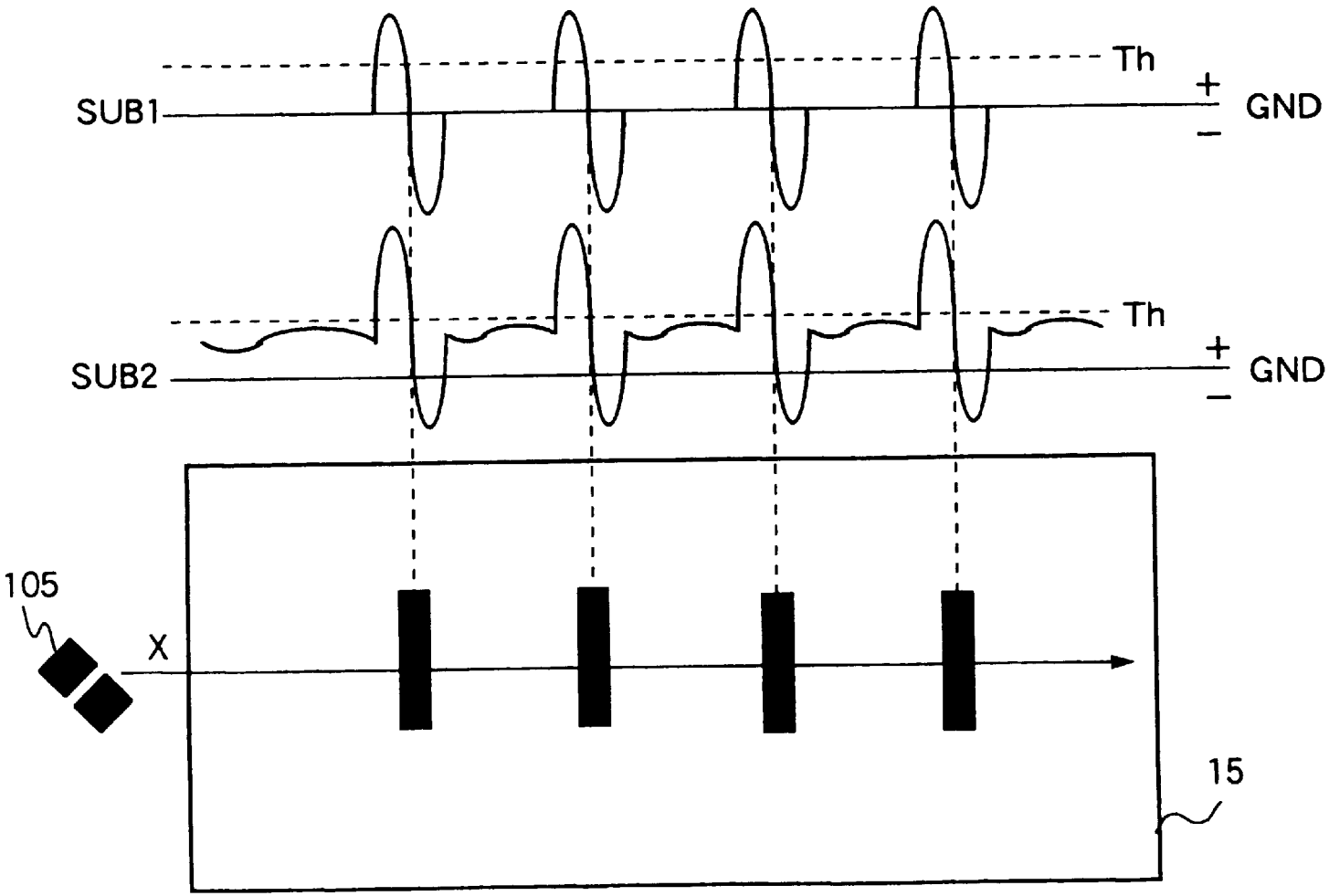
FIG. 26 is a diagram for explaining the subtracted outputs of two sensors which are obtained when the head height is changed with the configuration shown in FIG. 23.

However, in the configuration of FIG. 23, the shape of the light spot 252 formed on the paper sheet from the light emitting element 201 tilts relative to the array of the first and second light receiving elements 202, 203. Actually, illuminance of the light projected onto a paper sheet is not uniform in the spot, and hence, when a normal spot shape 251 tilts as indicated by the spot shape 252, the lights incident into the light receiving elements may change. As a result, as shown in FIG. 26, the subtracted output between the both light receiving elements may be shifted in the positive or negative direction with respect to the reference level (GND) over the entire paper sheet when the head is lifted up (SUB2) as compared to the normal case (SUB 1).

Such an event as the subtracted result from the outputs of the light receiving elements deviates positively or negatively from the reference level could occur also due to mechanical dispersion in mounting the sensor 105 on the carriage 102 in manufacturing products, non-uniformity of illuminance due to the light emitting element 201, errors in sensitivities of the light receiving elements 202, 203, and dispersion of constants of the amplifier circuits for amplifying the outputs of the light receiving elements.

Figure 27:
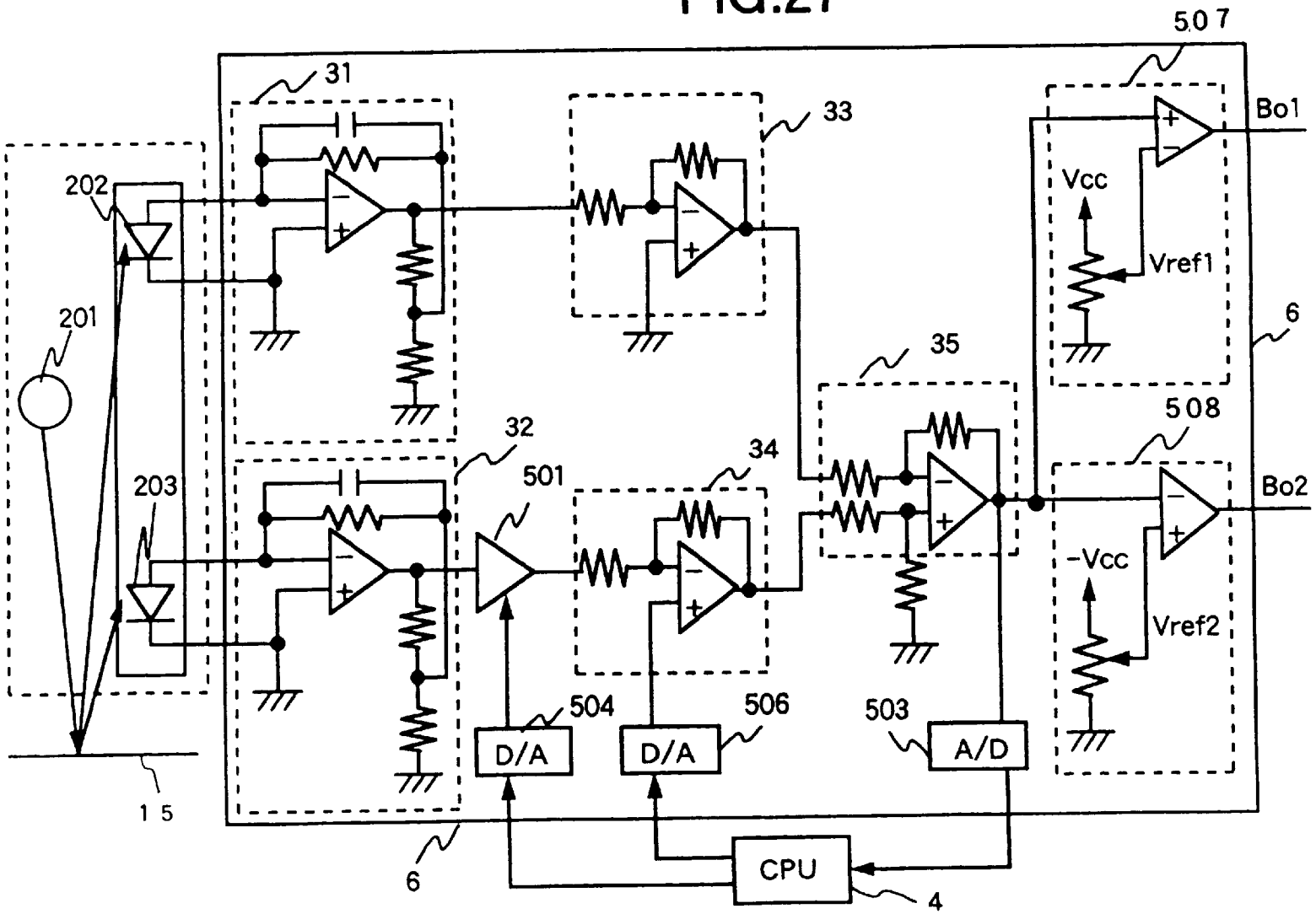
FIG. 27 shows an internal configuration of a pattern detection unit in a second embodiment according to the present invention.

Regarding such a problem, an exemplary configuration of the pattern detection unit 6 in this embodiment is shown in FIG. 27 where similar elements are assigned with the same reference symbols as those in FIG. 7. In this example, a variable-gain amplifier 501, an analog-to-digital (A/D) converter 503, a digital-to-analog (D/A) converters 504, 506 are newly provided, and the comparator 36 is replaced with comparators 507 and 508. The variable-gain amplifier 501 is configured to amplify the output of one (203 in this case) of the two light receiving elements 202, 203 at an arbitrary gain responsive to an instruction from the CPU 4. When a paper sheet is fed in after exchanging a head, or in response to a user's command to correct the registration errors, the light emitting element 201 is automatically turned on, and then, the gain of the variable-gain amplifier 501 is adjusted so as to cause the outputs from the light receiving elements 202, 203 are equalized at the same level. More specifically, the output of the differential amplifier 35 is monitored through the A/D converter 503 by the CPU 4, which in turn adjusts the gain of the variable-gain amplifier 501 through the D/A converter 504 so as to make the output stay at the reference level (GND).

In addition, the light receiving elements 202, 203 have individual temperature characteristics due to the dispersion in manufacturing, which will produce a difference between their output levels as the ambient temperature changes, resulting in a shift of the output of the differential amplifier 35 with respect to the reference level. To avoid this in this embodiment, as shown in FIG. 27, an automatic adjustment is performed so that the outputs from the receiving elements 202, 203, when the light emitting element 201 is in an OFF state, are at the same level. More specifically, similarly to the gain adjustment of the variable-gain amplifier 501, the output of the differential amplifier 35 is monitored through the A/D converter 503 by the CPU 4, which in turn adjusts the reference level of an inverting amplifier in the offset adjusting circuit 34 through the D/A converter 506.

Figure 28:
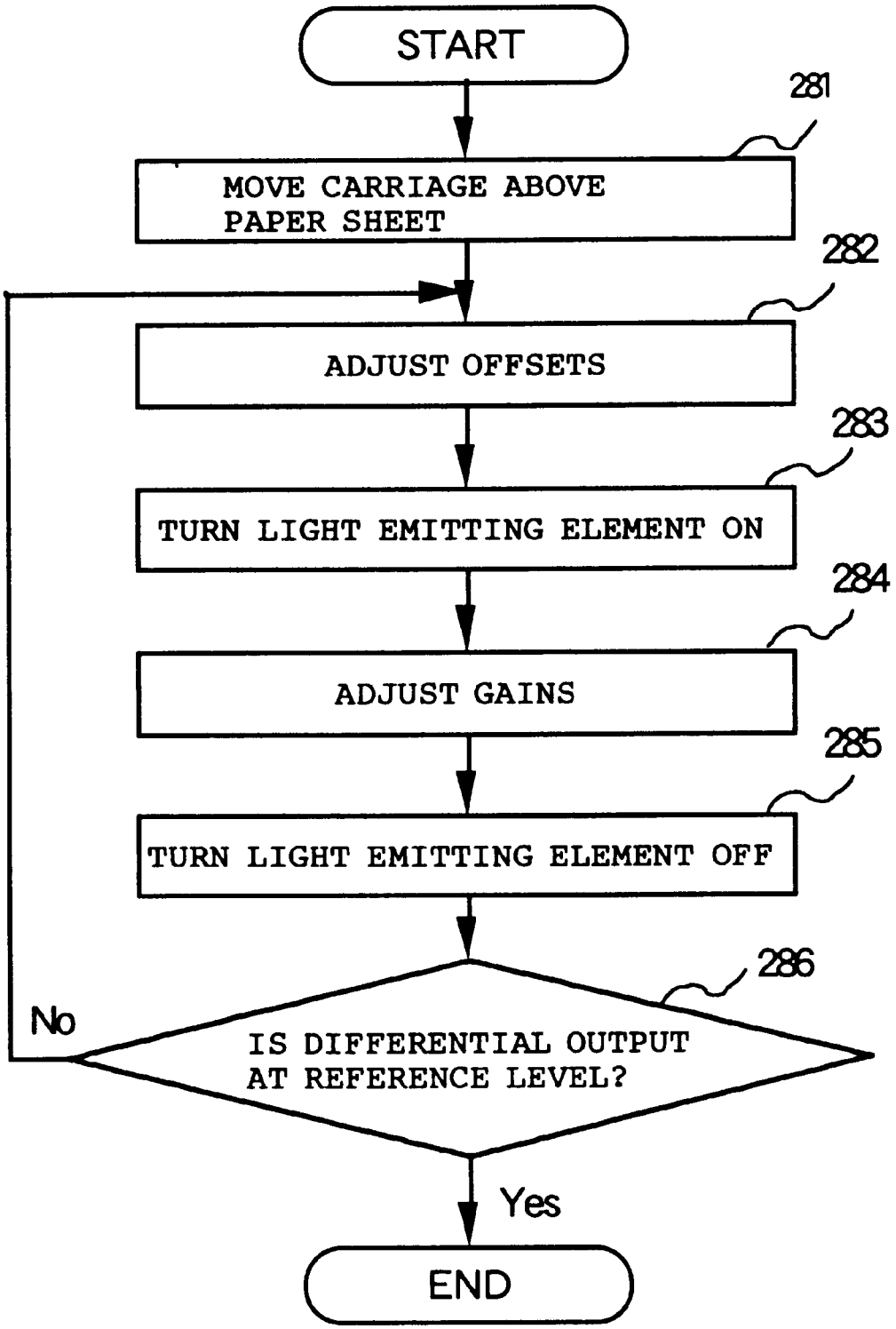
FIG. 28 is a flowchart showing a flow of the processing in the second embodiment.

Referring to FIG. 28, an explanation will be given of an operation in the embodiment.

First, if a command for correcting the registration error is issued after a paper sheet is fed in, then the carriage 102 is automatically moved above the paper sheet (281), and the offset adjustment is performed in the offset adjusting circuit 34 in a state where the light emitting element 201 remains off (282). After the differential output is adjusted at the reference level (GND) in the offset adjustment step, the light emitting element 201 is turned on (283), and the adjustment step for the variable gain amplifier 501 is initiated so as to make the differential output match the reference level (284). This gain adjustment will change the gain of the variable-gain amplifier 501, also changing the offset level when the light emitting element 201 is in an OFF state. To deal with this, the light emitting element 201 is turned off (285), the level of the differential output is checked (286), and then the offset adjustment step is again performed if the level has changed. The foregoing steps are iterated so that the differential output will not change from the reference level even when the light emitting elements 201 is turned on or off. At the time this state is obtained, the detection and correction of the registration errors are started.

According to the operation explained referring to FIG. 28, it is possible to keep the differential amplified output is kept constant regardless of the change in head height, dispersion in various element characteristics and mounting position, making it possible to realize the bi-level conversion with no detection errors.

After completion of the gain and offset adjustments, the printed pattern for detection of the registration errors are read and the bi-level conversion is performed at the comparators 507 and 508.

Figure 30:
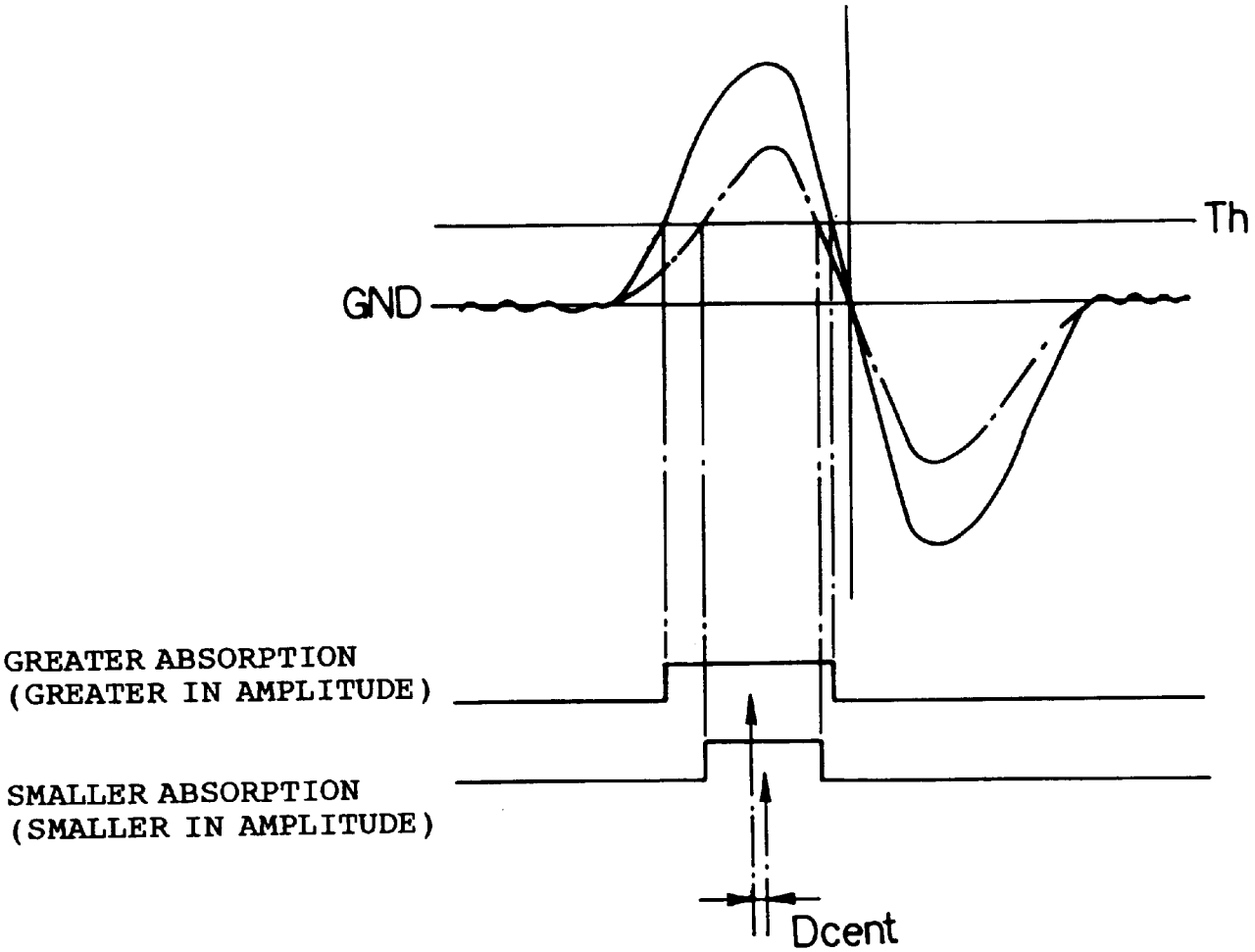
FIG. 30 is a waveform diagram which shows that the amplitude of a sensor output varies depending upon respective colors.

Incidentally, in the case as in the embodiment where four colors of ink heads are used and the entire pattern is read by a set of light emitting element and the light receiving elements, the sensor output will change in amplitude color by color as shown in FIG. 30, because a paper sheet exhibits a different amount of light absorption for each color. The difference in sensor amplitude causes the center position of the detected pulse width to be deviated (Dcent). For this reason, simply obtaining a pulse width based on the bi-level output, which is obtained from the differential amplified output by one comparator to obtain the center dot position, could cause the center position to deviate.

To overcome such a problem, in this embodiment, two comparators 507 and 508 are further provided, wherein their reference voltages (Vref1, Vref2) are set positive and negative, respectively, with respect to the reference level (GND). This allows respective bi-level conversions for the positive and negative portions of the output from the differential amplifier 35 so as to obtain the width of a printed region based on the respective bi-level outputs.

Now, an explanation will be given of a procedure from the calculation of the width of regions of a printed pattern to the determination of the amounts of errors of the respective regions.

The two bi-level signals are used in the registration error detection unit 7 to obtain widths of respective regions, and then the width data of each region is halved by the CPU 4 to determine the center dot position of the region.

Figure 29:
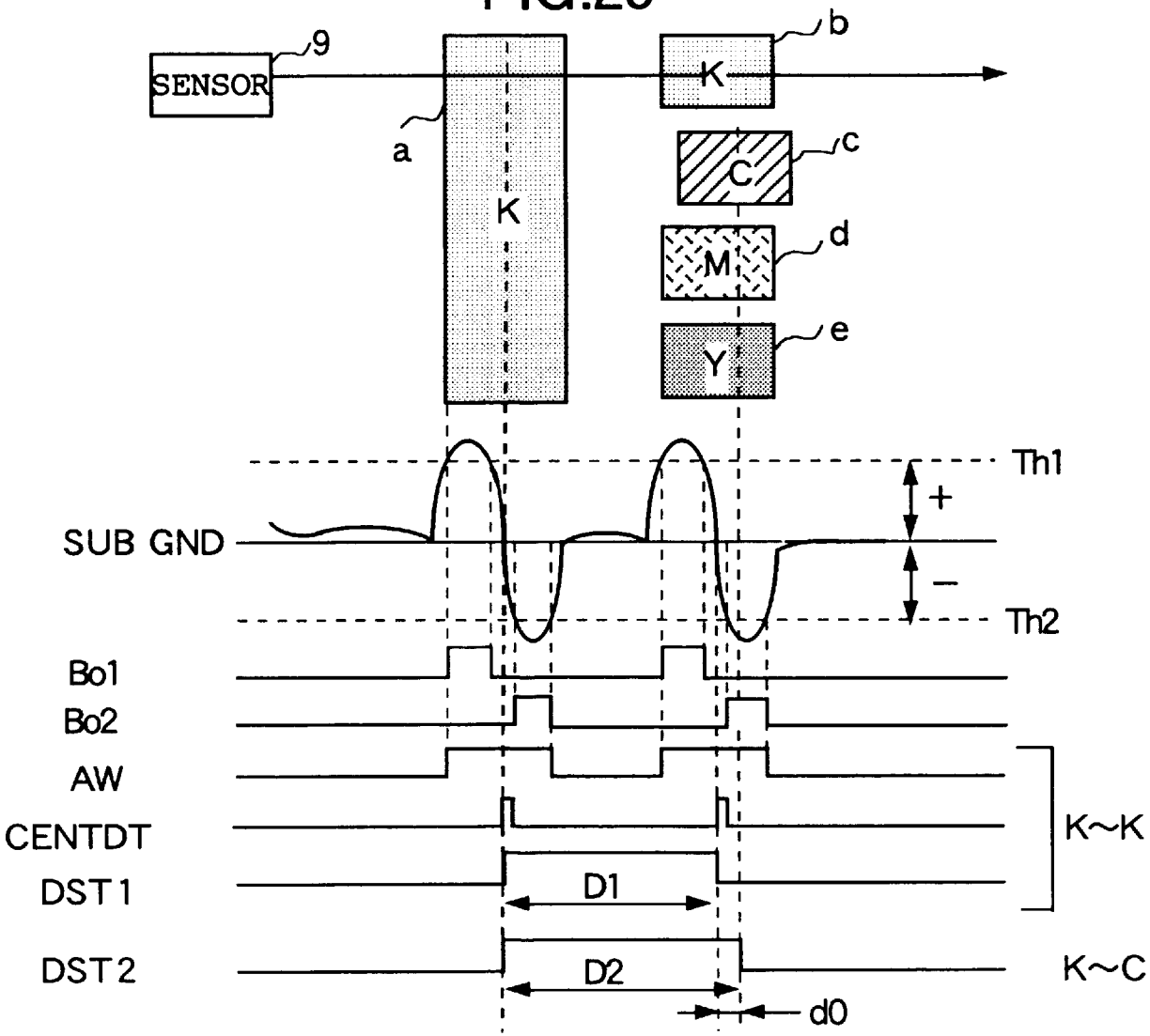
FIG. 29 is a diagram for explaining another method of detecting a pattern.
Figure 31:
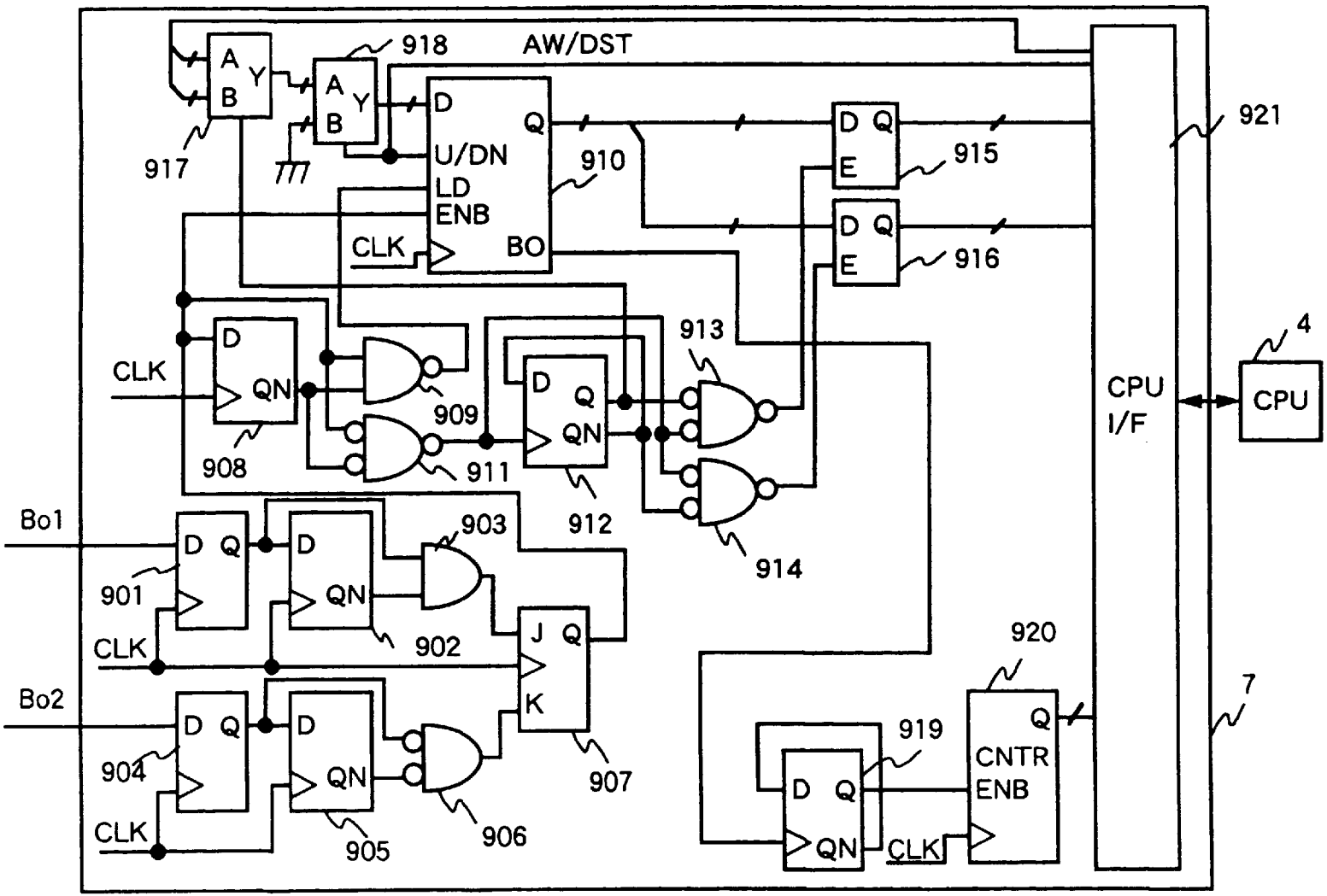
FIG. 31 is a circuit diagram which shows a configuration of a circuit for performing the pattern detection shown in FIG. 29.

Referring to FIG. 31, there is shown an example of internal circuit configuration of the registration error detection unit 7 in the embodiment. The operation of this circuit will be explained below referring to the waveforms as shown in FIG. 29.

In this circuit, firstly, a leading edge of the bi-level signal (Bo1), which has been derived from the positive portion of the output SUB of the differential amplifier 35 is detected with a reference clock (CLK) at flip-flops 901, 902 and an AND circuit 903, and a trailing edge of the bi-level signal (Bo2), which has been derived from the negative portion of the output SUB of the differential amplifier 35 is detected at flip-flops 904, 905 and an AND circuit 906. Then, a J-K flip-flop 907 generates a signal (AW) which has an enabling (effective) period between the two edges. This is a signal which indicates the width of a region. After the signal AW is generated, a load signal (LD) to operate an up-down counter 910 is generated by a flip-flop 908 and an AND circuit 909. At a leading edge of each region the up-down counter 910 is loaded with input data and performs up-counting during the enabled period of the signal PW. At this event, B input is selected as an input to a selector 918 so that a value 0 (HEX) is input to start the counting with 0. When the enabling of the signal PW is over, the count of the counter 910 is read in response to the outputs from AND circuits 911, 913, 914 and a flip-flop 912. In each scanning of the sensor, a pair of the reference region and a compared region are read. For this end, the AND circuits 913, 914 generate sampling signals to cause latch circuits 915, 916 to hold width data of the respective regions. Subsequently, the CPU 4 reads data out of the latch circuits 915 and 916 and halves the read-out data to calculate the half value of the width of the region.

With this arrangement, a width DST (described below) between the center dots can always stably be obtained because the center dot position will not change even if the amplitude of the sensor output varies color by color. After calculating the halved values of the region widths, the calculated data are selected at a selector 917. Then, the up-down counter 910 and the selector 918 are set for a down counting operation (AW/DST is set low "L"), and again, the same regions are scanned so that a borrow signals is output from the borrow output (BO) of the up-down counter 910 at each center dot position of the two regions. This borrow signal is a timing signal CENTDT which indicates a center dot position of each region. With this signal, a flip-flop 919 generates a signal DST which indicates the duration between the center dots of the regions, during which a counter 920 counts the width between the center dots. After completion of the count operation, the width data is read by CPU 4. This data is data D1 between the center dots of the regions a-b as shown in FIG. 29.

The above operation is successively iterated for a~c regions, a~d regions, and a~e regions to obtain the widths D2, . . . for each pair regions. After obtaining these data, with the data D1 for a~b regions used as a reference, it is possible to calculate differences between the data D1 and respective data D2, . . . to thereby calculate to what extent (d0) the heads are misaligned with respect to the reference head. Also it is possible to recognize in which direction the head is misaligned by judging from the sign (positive or negative) of the difference.

A CPU interface circuit 921 is provided to interconnect the CPU 4 between the selectors 917, 918, the up-down counter 910, the latch circuits 915, 916, and the counter 920.

As described hereinbefore, according to the present invention, the first and second light receiving elements are provided together with the subtraction means for subtracting one of the outputs of the first and second light receiving elements from the other, so that the outputs corresponding to floating portions of a paper sheet are cancelled, thereby accurately detecting the presence of each region of the printed pattern because of the time difference between the outputs corresponding to the printed pattern region. Also, the first and second light receiving elements are equally spaced from the light emitting element while their common center axis being tilted at an angle relative to the recording head-moving direction (main-scanning direction) and the recording medium-moving direction (sub-scanning direction), thereby accurately detecting the printed pattern regions for both of the main- and sub-scanning directions.

INDUSTRIAL APPLICABILITY

The present invention is preferably applicable to an image forming device of an ink type such as the ink jet, in which separate heads for plural colors of ink are mounted to perform a full-color printing.

I claim:

1. An ink-type image forming device having a plurality of recording heads mounted thereon which are moved to form an image on a recording medium, said ink-type image forming device, comprising:

a test pattern printing means for printing a predetermined test pattern on the recording medium by the use of said plurality of recording heads;

a reading means for reading the test pattern, which has been printed by said test pattern printing means, by optically scanning the test pattern;

a mounting-position-error detection means for detecting, with respect to a reference head being one of said plurality of recording heads, deviations in position of the recording heads other than said reference head; and said reading means including a light emitting element for projecting light onto the recording medium, and first and second light receiving elements which are disposed spaced apart from each other by a predetermined distance;

said mounting-position-error detection means including a subtraction means for subtracting an output of one of said first and second light receiving elements from an output of the other, and means for determining the deviations in position on the basis of a subtracted result.

2. The ink-type image forming device according to claim 1, further comprising a head scanning means for moving said plurality of recording heads in a main-scanning direction across the recording medium and a recording medium travelling means for moving the recording medium in a sub-scanning direction which is substantially perpendicular to said main-scanning direction, said first and second light receiving elements being disposed at the same distance from said light emitting element, and aligned along a line which lies at a predetermined angle relative to said head moving direction (main-scanning direction) and recording medium travelling direction (sub-scanning direction).

3. The ink-type image forming device according to claim 1, wherein said mounting-position-error detection means includes first and second amplifiers for amplifying outputs of said first and second light receiving elements, respectively, and a gain adjustment means for automatically adjusting a gain of at least one of said first and second amplifiers such that the outputs of the both light receiving elements are at the same level when said light emitting element is in an ON state.

4. The ink-type image forming device according to claim 3, wherein said mounting-position-error detection means includes an automatic offset adjustment means for automatically adjusting a reference level of at least one of the outputs of said first and second amplifiers such that the outputs of the both light receiving elements are at the same level when said light emitting element is in an OFF state.

5. The ink-type image forming device according to claim 1, wherein said mounting-position-error detection means includes first and second amplifiers for amplifying outputs of said first and second light receiving elements, respectively, and an automatic offset adjustment means for automatically adjusting a reference level for at least one of the outputs of said first and second amplifiers such that the outputs of the both light receiving elements are at the same level in a state where said light emitting element is turned off.

6. The ink-type image forming device according to claim 1, wherein said test pattern includes a substantially rectangular reference region, which is printed with a first one of said plurality of recording heads and elongated in a direction substantially perpendicular to the scanning direction of said reading means, and a plurality of compared regions having the same shape and printed, in parallel with each others with all of said plurality of recording heads at positions a predetermined distance away from said reference region in the scanning direction of said reading means.

7. The ink-type image forming device according to claim 6, wherein said mounting-position-error detection means includes a bi-level conversion circuit for converting an output of said subtraction means into a bi-level signal, and means for detecting an interval from a leading edge to a subsequent leading edge, or from a trailing edge to a subsequent trailing edge, of the output of said subtraction means, wherein intervals obtained by said detecting means with respect to respective compared regions are compared to detect the deviations in position of the heads.

8. The ink-type image forming device according to claim 6, wherein said mounting-position-error detection means includes means for obtaining center positions of widths of said reference region and respective compared regions, and means for obtaining intervals between the center position of said reference region and that of the respective compared region, wherein the intervals obtained by said detecting means with respect to respective compared regions are compared with each other to detect the deviations in position of the heads.

9. The ink-type image forming device according to claim 6, wherein said mounting-position-error detection means includes first and second bi-level conversion circuits each for converting an output of said subtraction means into a bi-level signal, said first bi-level conversion circuit performing a bi-level conversion with a first threshold level for detecting positive peaks of the output of said subtraction means while said second bi-level conversion circuit performing a bi-level conversion with a second threshold level for detecting negative peaks of the output of said subtraction means, thereby obtaining widths of the regions, which forms said test pattern, based on outputs from said first and second bi-level conversion circuits, obtaining center positions of the widths obtained, obtaining intervals between the center position of said reference region and the center positions of the respective compared regions, and comparing, with each other, the intervals obtained with respect to the respective compared regions so as to detect the deviations in position of the heads.

10. The ink-type image forming device according to claim 9, wherein the first and second threshold levels of said first and second bi-level conversion circuits are set at positive and negative levels equally spaced from a reference which is an output level of said subtraction means at a time when the outputs of said first and second light receiving elements are at the same level.

11. The ink-type image forming device according to claim 9, wherein said mounting-position-error detection means generates a signal, which indicates the width of each region of said test pattern, based on a leading edge of the output from said first bi-level conversion circuit and a trailing edge of the output from said second bi-level conversion circuit.

12. The ink-type image forming device according to claim 6, wherein the scanning direction of said reading means is one of a direction which is the same as the recording head scanning direction and a direction substantially perpendicular to the recording head scanning direction.

13. The ink-type image forming device according to claim 6, wherein said reference region and said compared regions of said test pattern are printed while said plurality of recording heads are being moved in the same direction, and said test pattern further includes an additional compared region which is printed while said plurality of recording heads are being moved in a reverse direction of said same direction.

14. The ink-type image forming device according to claim 10, wherein said mounting-position-error detection means generates a signal, which indicates the width of each region of said test pattern, based on a leading edge of the output from said first bi-level conversion circuit and a trailing edge of the output from said second bi-level conversion circuit.

* * * * *